US006868165B1

(12) United States Patent
Fabian

(10) Patent No.: US 6,868,165 B1
(45) Date of Patent: Mar. 15, 2005

(54) LOUDSPEAKER

(75) Inventor: Frank W. Fabian, Toronto (CA)

(73) Assignee: The Canadian Loudspeaker Corporation, Toronto (CA)

( * ) Notice: Subject to any disclaimer, the term of this patent is extended or adjusted under 35 U.S.C. 154(b) by 0 days.

(21) Appl. No.: 09/302,407

(22) Filed: Apr. 30, 1999

(30) Foreign Application Priority Data

Sep. 8, 1998 (CA) ..... 2245351

(51) Int. Cl.[7] ..... H04R 25/00

(52) U.S. Cl. ..... 381/397; 381/412; 381/406; 381/419; 381/420

(58) Field of Search ..... 381/397, 411, 381/406, 412, 419, 410, 420, 421, 386, 422, 418

(56) References Cited

U.S. PATENT DOCUMENTS 2,261,110 A * 11/1941 Engholm
2,261,111 A * 11/1941 Engholm
5,042,072 A * 8/1991 Button ..... 381/397
5,335,287 A 8/1994 Athanas ..... 381/197
5,357,586 A * 10/1994 Nordschow
5,461,677 A * 10/1995 Raj
5,497,428 A 3/1996 Rojas ..... 381/199
5,909,015 A * 6/1999 Yamamoto et al. ..... 181/156

* cited by examiner

*Primary Examiner*—Huyen Le
*Assistant Examiner*—Dionne Harvey

(57) ABSTRACT

A loudspeaker has a magnetic flux assembly that has a pole piece and a plate and magnet structure for co-operating with a voice coil. The plate structure includes a top plate which is mounted adjacent to the diaphragm assembly of the loudspeaker. There is a cavity within the voice coil and between the diaphragm membrane and the top of the pole piece. A fluid flow passage is provide to permit air displaced to and from the cavity during movement of the diaphragm assembly to flow through the top plate and to encourage cooling of the assembly.

48 Claims, 13 Drawing Sheets

LOUDSPEAKER

FIELD OF INVENTION

This invention relates generally to the field of loud speakers.

BACKGROUND ART

A typical loudspeaker assembly for low to mid-range audible sound reproduction, that is, a bass speaker, or a "woofer", has a magnetic sandwich assembly. The core of the sandwich is typically, an annular magnet, although square or rectangular open center magnets are also known. A backplate, typically circular, is mounted to one annular face of the magnet, and has an outside diameter similar to, the outside diameter of the annular magnet. An annular top plate is mounted to the other face of the magnet. The top plate has an outside diameter similar to the backplate, and an inside diameter less than the inner diameter of the annular magnet. The magnet, the backplate, and the top plate are concentrically mounted about a central axis perpendicular to the annular magnet. The polarity of the magnet is such that the annular top and bottom faces are opposite poles.

In general, the magnet sandwich assembly has a central post, sometimes called a pole piece, a T-yoke, or a core. The pole piece is mounted along the central axis of the magnetic assembly to extend from the backplate toward the top plate. The end of the pole-piece standing furthest away from the backplate usually sits adjacent the inner annular edge or face of the top plate. A small radial gap is left between the top plate and the end of the pole piece. Inasmuch as the top plate, the backplate, and the pole-piece are typically made of ferromagnetic materials, or materials of high magnetic permeability, a magnetic flux field is established by the magnet across the small gap. Thus the magnetic flux path lies completely in materials of relatively high magnetic permeability except for the gas, typically air, in the gap between the inner edge of the annular member and the central post.

A voice coil is suspended to ride in the small gap, which is the location of maximum magnetic flux density. The voice coil can reciprocate linearly relative to the pole piece, and, in so doing, the turns of the coil traverse the field of the magnet. The voice coil is suspended from a resilient suspension, usually in the form of a moving diaphragm assembly mounted on springs. The diaphragm assembly usually has a membrane element that has the shape of a truncated section of a cone, with a dust cap membrane extending across a narrower part of the section. The lead wires for the coil are usually, though not always, mounted to the cone, typically with glue, and the cone and the voice coil are constrained to move together.

Loudspeaker performance reflects design compromises in the desired power output, the choice of magnet, the choice of coil, the nature of the resilient mounting, the entrapment of air in the assembly, and the size and shape of the cabinetry placed about the loudspeaker itself. A loudspeaker will tend to have a chosen desired operating bandwidth. In general, when operated outside the design bandwidth the speaker is more likely to exhibit non-linear performance, and more likely to exhibit undesirable, or less than optimal, impedance characteristics, and may tend to be more prone to failure.

In operation, the varying electrical current in the voice coil will tend to cause the voice coil to become warm. The heating of the coil is known, and one design consideration is the anticipated operating temperature. When the coil becomes warm, the adjacent metal structure also becomes warm, though generally to a lesser degree. The electrical resistance of copper wire increases with increasing temperature. Inasmuch as the power output of a speaker varies inversely as the resistance of the voice coil, an increase in the temperature of the coil will tend to reduce the current in the coil, and reduce the output power. As a consequence, it is advantageous to keep the voice coil relatively cool, if possible. If the coil is operated too vigorously, its performance will deteriorate, and may ultimately fail. Voice coils of aluminium wire are less likely then copper coils to have a general rise in impedance with increasing power, but also have a tendency to fail with increasing temperature.

In the past, a common solution to the problem of increased resistance due to coil warming has been to choose a larger, heavier speaker to give a higher output power level. A larger voice coil, magnetic assembly, or both, will usually be capable of producing the same power output as a smaller one but with a lower temperature rise, and less deterioration in performance. To maintain the same specified ratio of output to losses, $Q_{es}$, and therefore $Qt_s$, it would be customary to increase both the size of the magnet and the size of the coil. It would be advantageous to reduce the operating temperature of the voice coil to permit a smaller motor, {that is, a coil and magnet assembly), to be used at higher power levels, rather than having to adopt a bigger, heavier, and possibly more expensive, unit.

At present, it is not uncommon for the pole piece of a woofer to be hollow, and for the back plate to have a central opening. When the diaphragm moves, the air pocket beneath the dust cover membrane then has an outlet to ambient through the hollow pole piece and through the backplate, so pressure variation in the pocket is reduced. One attempt to use the motion of the air displaced by the dust cover dome to enhance cooling is shown in U.S. Pat. No. 5,042,072 of Button, issued Aug. 20, 1991. Button forms three peripheral grooves in the outer face of the pole piece. These channels vent through the backplate. The usually open hollow core of the pole-piece is blocked such that air is forced to move in or out through the three channels. Inasmuch as the radially outer portion of the channels is bounded by the inner face of the voice coil, Button indicates that portions of the voice coil are cooled by forcing air displaced by the dome through the channels next to the voice coil.

U.S. Pat. No. 5,357,586 of Nordschow and Wright, issued Oct. 18, 1994. It shows a speaker that has radial perforations in the voice coil former at a level above the voice coil. A vane, or aerodynamically shaped body, is mounted within the hollow core of the pole-piece. Air flows more easily past the aerodynamically shaped body in one direction than the other, such that reciprocation of the diaphragm will tend to cause a flow of air through the assembly between the perforations and the opening in the backplate, with a cooling effect.

U.S. Pat. No. 5,497,428 of Rojas issued Mar. 5, 1996. It shows a loudspeaker assembly with channels formed in the external periphery of the pole-piece adjacent to the voice coil. These channels vent into the hollow central core of the pole piece, which, as is customary, is open through the backplate to ambient. The top end of the pole piece is blocked by a generally conical part, such that the air is forced to flow through the channels.

Another noted phenomenon of existing loudspeakers in which the backplate of the speaker is a closed plate, is that the reciprocation of the diaphragm assembly, as in a closed back mid-range to high audible frequency unit, or tweeter, will tend to compress or expand, the air trapped within the loudspeaker casing itself. Where the entrapped volume is small, the effect can be quite pronounced. It is desirable in such instances to increase the internal trapped volume so that the volume displaced by operation of the speaker diaphragm is small relative to the trapped volume, with a consequent lessening of the pressure fluctuations in the entrapped gas. It will be apparent that compression of the entrapped gas will tend to oppose the motion of the speaker, and may complicate it still more if there is a dynamic resonance problem. A known method of reducing the magnitude of this phenomenon is to provide a larger backshell or housing. This is generally not desirable because it increases the size of the loudspeaker unit for the purpose of enclosing air. It would be advantageous to increase the volume of the entrapped air without having to increase the physical size of the loudspeaker envelope.

U.S. Pat. No. 5,335,287 of Athanas, issued Aug. 2, 1994 relates to a loudspeaker employing a magnetic liquid suspension for locating the voice coil in the gap. According to Athanas, one problem of magnetic liquid voice coils is that the liquid has a tendency to be blown, or drawn, out of the magnetic gap. In Athanas' view this was because the oscillatory motion of the voice coil produces momentary changes in the atmosphere near the end of the pole piece, and in the annular chamber surrounding the pole piece. The loudspeaker shown by Athanas has not only a port through the back plate to vent the hollow core of the pole piece, but also additional vents formed through the backplate to vent the annular chamber formed between the pole piece and the magnet. This is thought to reduce the tendency of the air compressed in the annular chamber from pushing the liquid out of the gap.

SUMMARY OF THE INVENTION

In one aspect of the invention there is a magnetically permeable plate for use as the front plate of a magnetic flux path assembly of a loudspeaker. The loudspeaker has a diaphragm driven by a voice coil. The magnetic flux assembly has a pole piece, a magnet, and a magnetic flux path between one pole of the magnet and the pole piece. The plate has an opening defined therein sized to fit about the pole piece and to co-operate with the pole piece to define a gap for accommodating movement of the voice coil therebetween. The top plate has venting defined therein to permit fluid communication through the plate external to the voice coil.

In an additional feature of that aspect of the invention the plate has an outer periphery, an inner periphery defining the opening, and the venting is segregated from the inner periphery. In another additional feature of that aspect of the invention the plate has the form of a disc in which the inner and outer peripheries are circular and concentric. In still another additional feature of that aspect of the invention the venting includes an array of apertures spaced outwardly from, and having a pitch circle concentric with, the inner periphery. In a further additional feature of that aspect of the invention the apertures are circular. In a still further additional feature of that aspect of the invention the opening has a nominal periphery and the venting includes at least one rebate let into the nominal periphery. In a yet further additional feature of that aspect of the invention the opening has a crenellated profile.

In another aspect of the invention, there is a magnetic flux path assembly for a loudspeaker having a diaphragm, a voice coil for driving the diaphragm and a diaphragm dust cap cavity defined therewithin. The magnetic flux path assembly has a pole piece, an opposed member placed in spaced relationship from the pole piece to define a gap for accommodating reciprocation of the voice coil, and at least one intermediate member mounted to maintain the position of the pole piece and the opposed member relative to each other. The pole piece, the intermediate member, and the opposed member co-operate to form a continuous path of higher magnetic permeability than the gap. At least one of the pole piece, the at least one intermediate member, and the opposed member includes a magnet for establishing a magnetic flux in the magnetic flux path assembly and across the gap. The magnetic flux path assembly has an airflow path defined therein extending between the dust cap cavity and external ambient, for permitting displacement of air between the cavity and external ambient. At least a portion of the airflow path is defined in the opposed member external to the gap, whereby displacement of air by the dust cap member causes motion of air in the portion of the airflow path in the opposed member to encourage cooling of the opposed member.

In an additional feature of that aspect of the invention, the opposed member is a plate having an outer periphery. A closed inner periphery defines an opening extending about the pole piece. The gap lies between the periphery and the pole piece. A portion of the airflow path is formed in the plate and is segregated from the opening. In another additional feature of that aspect of the invention, the plate has the form of a disc in which the inner and outer peripheries are circular and concentric. In still another additional feature of that aspect of the invention, the portion of the airflow path formed in the plate includes an array of apertures spaced outwardly from, and having a pitch circle concentric with, the inner periphery.

In still yet another additional feature of that aspect of the invention, the opposed member is a plate having an outer periphery. A closed inner periphery defines an opening extending about the pole piece. The gap lies between the periphery and the pole piece. At least one portion of the inner periphery defines the gap, and another portion of the periphery defines the portion of the airflow path defined in the opposed member.

In a further additional feature of that aspect of the invention, the magnetic flux path assembly has an axis parallel to the direction of reciprocation of the voice coil. The pole piece has a distal region thereof distant from the rigid member. The distal region has the form of a body of revolution concentric with the axis. The opposed member is a plate having a closed inner periphery extending about the pole piece distal region. The inner periphery has at least one sector of a circular arc concentric with the distal region. The sector has a radius. The inner periphery also includes at least one relief defined in the plate. The relief extends radially outward relative to the radius of the sector. The gap is defined between the sector and the pole piece. The relief defines at least a part of the portion of the airflow path defined in the opposed member.

In yet a further additional feature of that aspect of the invention, the assembly has a central axis. The pole piece has a round portion. The opposed member is a disc having an outer periphery and a closed inner periphery extending about the round portion of the pole piece. The inner periphery has a plurality of sectors of a circular arc having a common radius, and a plurality of reliefs defined in the disc extending radially outward relative to the radius of the sectors. The round portion of the pole piece and the sectors are concentric about the axis. The gap is defined between the sectors and the pole piece, and the portion of the airflow path being defined, at least in part, by the reliefs. The reliefs and the sectors are arranged in a symmetrical array about the axis. In still yet a further additional feature of that aspect of the invention, the pole piece includes a the magnet.

In an additional feature of that aspect of the invention, for a loudspeaker having a round cylindrical voice coil for driving the diaphragm along an axis of reciprocation, and supporting structure for mounting the diaphragm to the flux path assembly, the opposed piece is a first plate mounted to one portion of the intermediate member. The intermediate member includes structure extending away from the first plate, and a second plate mounted to the structure parallel to the first plate. The first plate has an inner periphery defining an opening, and the pole piece is mounted to extend at least partially from the second plate toward the first plate. The pole piece and the inner periphery co-operate to define a gap for accommodating reciprocating motion of the voice coil with the pole piece located internally with respect to the voice coil. The magnetic flux path assembly has an enclosed space defined between the pole piece, the structure, and the pair of plates. The pole piece has a first passageway defined therein to permit fluid communication between the cavity and the space. The first plate has venting defined therein to permit fluid communication between the space and external ambient.

In another additional feature of that aspect of the invention, the magnet has a circular cross-section perpendicular to the axis and a distal end extending away from the intermediate member. The pole piece has an end cap surmounting the distal end of the magnet. The end cap has a circular cross-section perpendicular to the axis and has a larger diameter than the distal end of the magnet. The distal end member has passages defined therethrough permitting, in use, fluid communication between the cavity and the space. In still another additional feature of that aspect of the invention, the end cap has an external periphery and the passages are channels formed in the periphery. In yet another additional feature of that aspect of the invention, the end cap has a round circular periphery and the passages are apertures formed through the end cap.

In another additional feature of that aspect of the invention, the venting includes flow director elements for enhancing convective heat transfer from the voice coil. In still another additional feature of that aspect of the invention, the venting includes at least one deflector for directing airflow toward the voice coil.

In yet still another additional feature of that aspect of the invention, the venting includes at least one tube having an outlet oriented to urge air displaced through the tube toward a portion of the voice coil.

In a further additional feature of that aspect of the invention, the tube is a bent tube having a pair of ends. One of the ends is oriented to urge air displaced through the tube toward a portion of the voice coil during flow in one direction. The other is oriented to urge air displaced through the tube toward a portion of the voice coil during flow in the other direction.

In still a further additional feature of that aspect of the invention, for a voice coil having an external surface, the opposed member is a plate having a closed inner periphery defining an opening extending about the pole piece. The gap is defined between at least one portion of the periphery and the pole piece. The venting is defined by another portion of the periphery in the nature of a relief defined in the plate. The relief extends radially away from the pole piece and permits air to traverse the plate. The assembly has at least one air guide mounted to the plate to direct air flowing through the relief along at least a portion of the external surface of the voice coil.

In yet a further additional feature of that aspect of the invention, the assembly includes an array of the reliefs and a corresponding array of air guides spaced about the axis. In still yet a further additional feature of that aspect of the invention, the assembly has an internal enclosed space, and the venting permits air flow between the internal enclosed space and external ambient. The assembly has associated with at least one relief, an air guide mounted to extend from one side of the plate, and another air guide mounted to extend away from the other side of the plate. In yet another further additional feature of that aspect of the invention, the air guide is a channel having an open longitudinal side facing the voice coil, and the channel extends parallel to the axis.

In another aspect of the invention, there is a magnetic flux path assembly for a loudspeaker having a diaphragm, and a round cylindrical voice coil for driving the diaphragm along an axis of reciprocation. The voice coil and a diaphragm dust cap cavity are defined there within, and supporting structure for mounting the diaphragm to the flux path assembly. The magnetic flux path assembly has an annular magnet having a pair of annular faces and an inner wall defining an eye therethrough. It has a first plate mounted to one annular face of the magnet, a second plate mounted to the other annular face of the magnet, and a pole piece. The first plate has an inner periphery defining an opening, and the pole piece is mounted to extend at least partially through the eye from the second plate toward the first plate. The pole piece and the inner periphery co-operate to define a gap for accommodating reciprocating motion of the voice coil with the pole piece located internally with respect to the voice coil. The magnetic flux path assembly has a space defined between the pole piece, the inner wall of the magnet, and the pair of plates. The pole piece has a first passageway defined therein to permit fluid communication between the cavity and the space. The first plate has venting defined therein to permit fluid communication between the space and external ambient.

In an additional feature of that aspect of the invention, the venting includes at least one aperture defined in the first plate, the aperture being segregated from the opening. In another additional feature of that aspect of the invention, the periphery includes at least one sector of a circular arc. The sector has a radius measured from the axis and relief defined in the first plate. The relief extends away from the axis a distance greater than the radius of the sector, whereby the venting is at least partially defined by the relief. In still another additional feature of that aspect of the invention, the pole piece is a hollow cylinder having a base end mounted to the second plate, a distal end for location within the voice coil, and a wall extending between the ends. The base end is closed. The distal end has an opening defined therein. The wall has at least one port defined therein to permit fluid flow between the cavity and the space through the cylinder.

In yet another additional feature of that aspect of the invention, the pole piece is a post having a base end mounted to the second plate, a distal end for location within the voice coil, the distal end having an end face for location facing the cavity, and a wall extending between the ends, a portion of the wall bounding the space. The pole piece has a passageway defined therein. One end of the passageway terminates at a port defined in the end face of the distal end of the pole piece. The passageway has another end that terminates at a port defined in the portion of the wall bounding the space.

In a further additional feature of that aspect of the invention, the passageway is a straight bore formed in the pole piece on an inclined angle relative to the axis. In still a further alternative additional feature of that aspect of the invention, the passageway has a first bore extending inwardly from the one end of the passageway, and a second bore extending inwardly from the other end of the passageway to intersect the first bore. In yet a further alternative additional feature of that aspect of the invention, the passageway has a first bore extending inwardly from the one end of the passageway, and a second bore extending inwardly from the other end of the passageway to intersect the first bore. In another additional feature of that additional feature, the second bore is a cross-bore extending fully through the pole-piece and having openings at either end thereof.

In still another additional feature of that aspect of the invention, the pole piece is a post having a base end mounted to the second plate; a distal end for location within the voice coil, the distal end having an end face for location facing the cavity; a medial portion narrower than the distal end; and a transition wall extending between the distal end and the medial portion. A portion of the transition wall bounds the space. The pole piece has a passageway defined in it. One end of the passageway terminates at a port defined in the end face of the distal end of the pole piece. The passageway has another end that terminates at a port defined in the portion of the transition wall bounding the space.

In yet another additional feature of that aspect of the invention, the transition wall is chosen from the set of transition walls consisting of an annular shoulder extending radially perpendicular to the axis and a truncated conically tapered section. The passage is a bore extending parallel to the axis. In still another additional feature of that aspect of the invention, the pole piece is a post having a base end mounted to the second plate, a distal end for location within the voice coil, the distal end having an end face for location facing the cavity, and a wall extending between the ends. A portion of the wall bounds the space; and distal end of the pole piece has a sidewall extending parallel to the axis. The sidewall has a radius measured from the axis, and at least one relief defined in the sidewall. The relief extends radially inwardly relative to the radius of the sidewall. The relief has a first end defined in the end face, and a second end giving onto the enclosed space, whereby air can be displaced along the relief between the cavity and the enclosed space.

In yet still another additional feature of that aspect of the invention, the relief in the distal end of the pole piece is a groove formed in the pole piece. The groove extends parallel to the axis. In a further additional feature of that aspect of the invention, the inner periphery of the first plate includes at least one sector of a circular arc. The sector has a radius measured from the axis. The inner periphery also includes at least one first plate relief defined in the first plate. The first plate relief extends away from the axis a distance greater than the radius of the sector, whereby the venting is at least partially defined by the first plate relief.

In still a further additional feature of that aspect of the invention, the at least one first plate relief is an array of slots formed in the first plate in a symmetrical pattern relative to the axis. The at least one relief in the pole piece is an array of grooves formed in the pole piece. The number of slots is equal to the number of grooves, and the slots are aligned opposite the grooves.

In another aspect of the invention, there is a loudspeaker. It has a diaphragm assembly having a movable membrane, a dust cap mounted to the moveable membrane, a voice coil former, a voice coil formed thereon, and a cavity defined within the dust cap and the former. The loudspeaker also has a magnetic flux path assembly having a magnet. A flux land is connected in a magnetically permeable path to one pole of the magnet. A pole piece is connected in a magnetically permeable path to the other pole of the magnet. The diaphragm assembly has framing mounted to the magnetic flux path assembly and a suspension to permit the voice coil to reciprocate relative to the framing. The pole piece extends within at least a part of the voice coil. The flux land is located in spaced relationship from the pole piece to define a gap therebetween for accommodating reciprocation of the voice coil. The magnet develops a magnetic flux across the gap. The loudspeaker has an internal space defined between the pole piece, the magnet, and the flux land. The pole piece has a passageway defined therein having a port opening on the cavity and another port opening on the space. The flux land has venting let therethrough to permit fluid communication between the space and an external environment, whereby displacement of the dust cap urges fluid to be displaced between the cavity and the external environment along a fluid communication pathway that includes the passageway, the space, and the venting.

In an additional feature of that aspect of the invention, a magnetically permeable suspension fluid is introduced into the gap. In another additional feature of that aspect of the invention, the pole piece is a hollow post. The port opening on the cavity is an open end of the post. The port opening on the space is an aperture let through a sidewall of the post, and the post has a base end, opposite to the open end, the base end being closed. In still another additional feature of that aspect of the invention, the pole piece is a post having a groove let along a face thereof. The port opening on the cavity is one end of the spline, and the port opening on the space is another part of the spline. In still yet another additional feature of that aspect of the invention, the pole piece is a post having a longitudinal axis parallel to the direction of reciprocation of the voice coil, and the spline is parallel to the axis.

In another aspect of the invention there is a loudspeaker. It has a diaphragm assembly having a movable membrane, a voice coil former, a voice coil formed thereon, and a cavity defined within the membrane and the former. It has a magnetic flux path assembly having a magnet, a flux land connected in a magnetically permeable path to one pole of the magnet, and a pole piece connected in a magnetically permeable path to the other pole of the magnet. The diaphragm assembly is mounted to the magnetic flux path assembly, and has a suspension to permit the voice coil to reciprocate relative to the magnetic flux path assembly. The pole piece has a post for extending within at least a part of the voice coil. The flux land is located in spaced relationship from the pole piece to define a gap therebetween for accommodating reciprocation of the voice coil, the magnet developing a magnetic flux field across the gap. The loudspeaker has an internal space defined between the pole piece, the magnet, and the flux land. The flux land has venting let therethrough to permit fluid communication between the space and an external environment.

DETAILED DESCRIPTION OF THE INVENTION

Figure 1:
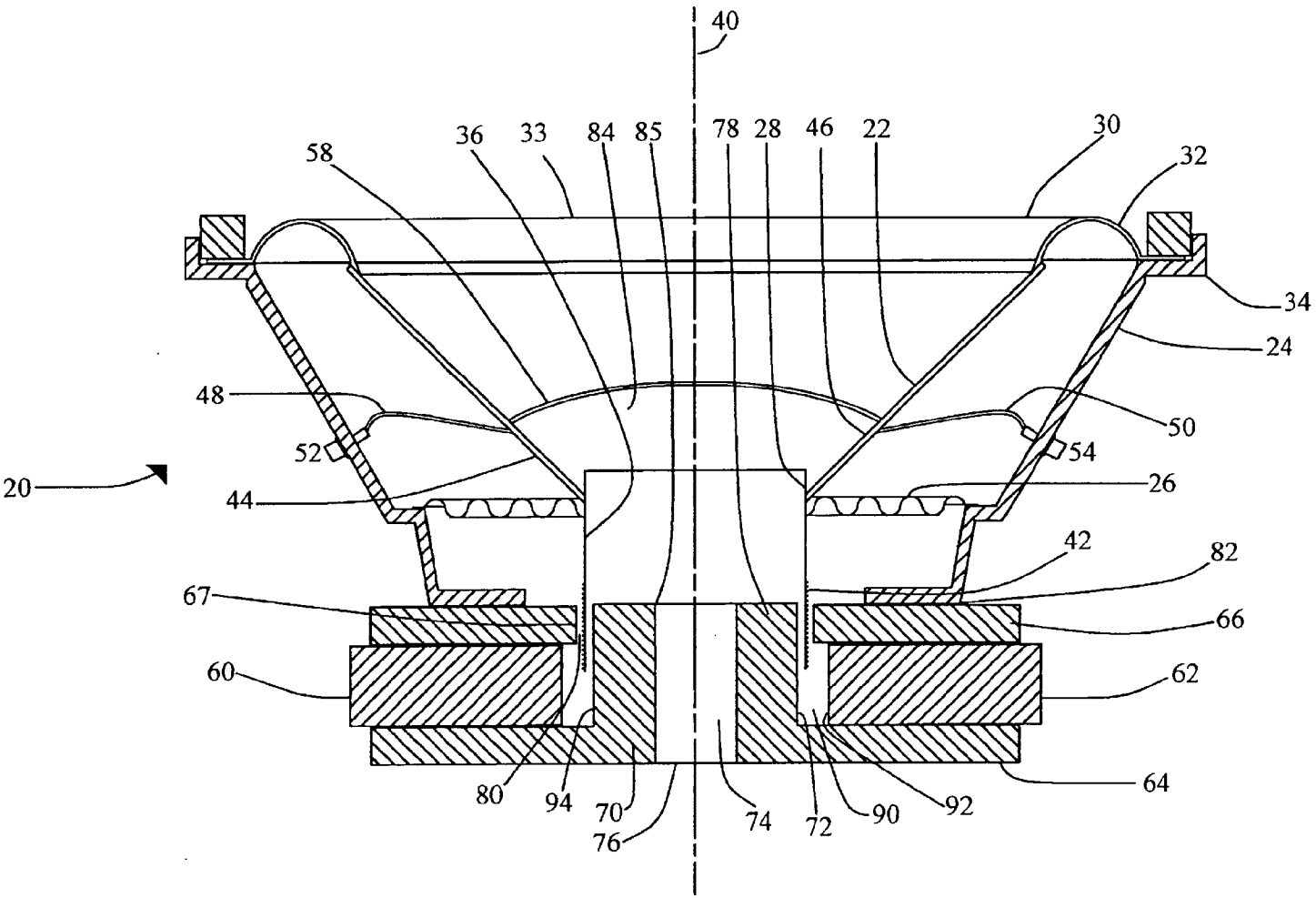
FIG. 1 is a cross sectional view of a loudspeaker assembly of conventional construction.

The description which follows, and the embodiments described therein, are provided by way of illustration of an example, or examples of particular embodiments of the principles of the present invention. These examples are provided for the purposes of explanation, and not of limitation, of those principles and of the invention. In the description which follows, like parts are marked throughout the specification and the drawings with the same respective reference numerals. The drawings are not necessarily to scale and in some instances proportions may have been exaggerated in order more clearly to depict certain features of the invention. It will also be understood that although the loudspeakers described herein are shown in an upwardly oriented position, loudspeakers generally can be placed in horizontal, vertical, or tilted orientations. The terminology used when referring to top, back, front, inward, outward, upper or lower or other such term is not limited to a single orientation, but is given in the context of the illustrations.

Referring to FIG. 1, a low to mid-range frequency speaker, commonly referred to as a "woofer" is indicated generally as 20, is shown in cross section. Loudspeaker 20 has a generally conical diaphragm member 22 that is mounted to a housing in the nature of a frame 24, sometimes referred to as a "basket". The mounting of diaphragm member 22 is a resilient mounting having a lower, or inner suspension element in the nature of a damper, or spider 26 that extends from a narrower region of frame 24 to the throat 28 of diaphragm member 22; and an upper, or outer, suspension member 30 in the nature of a surround 32, of generally semicircular cross-section, that extends between the mouth 33 of conical diaphragm member 22 and the wider periphery 34 of the distal portion of frame 24.

A round, cylindrical voice coil former, or bobbin 36, depends from throat 28 of member 22, to extend away from member 22. The wall of bobbin 36 lies about an axis of linear reciprocation 40, that is also the axis of revolution of conical diaphragm member 22, and the central axis of loudspeaker 20 generally. Bobbin 36 is a thin walled, rigid circular cylinder, generally made of paper, KAPTON (T.M.), NOMEX (T.M.), aluminium, or other suitable material, upon which a voice coil 42 is wound. Voice coil 42 has a pair of leads 44 and 46 that extend along, and are glued to, the skin of conical diaphragm member 22. A pair of flex, or tinsel, leads 48 and 50 carry input signals from terminals 52 and 54 to leads 46 and 48.

The major portion of diaphragm member 22 is a truncated conical section, but is also includes a sealed membrane, in the nature of a dust cap 58 that extends across, and seals, the narrow, inner end of the conical section. Although member 22 is shown in the form of a truncated conical section, other shapes of diaphragm can be used, such as a spherical section, an ellipsoidal section, a pyramidal section, or a flat panel. It could also be a fully conical section extending to a point, without a dust cap membrane on a different arc or plane. In each case the diaphragm assembly is such that it closes the end of the voice coil bobbin.

A magnet assembly 60 has an annular magnet 62, a back plate 64, and an inner, or top plate 66, formed in a sandwich that is concentric about axis 40. A pole piece in the nature of a central, round, cylindrical post 70 extends inwardly from back plate 64 towards conical diaphragm member 22. The outer face 72 of post 70 has a diameter sufficiently smaller than the inside diameter of bobbin 34 to permit voice coil 42 to reciprocate in a direction of reciprocation parallel to axis 40. A pole piece, like post 70, is also sometimes called a T-yoke. Pole pieces can be formed integrally with back plate 64, either by machining from solid, by die casting, or by sintering of a compressed press powder metal part. Pole pieces can also be made by cold forming a cylindrical part to clinch on back plate 64, or by welding, or a number of other fabricating processes. A typical pole piece, such as post 70, has a central through bore 74, that carries through an opening 76 in back plate 64 to give an airflow passage to external ambient. Most typically, top plate 66 is a flat, annular disc having one face bonded to magnet 62. Top plate 66 has an inner face 76 having an inside diameter that is just large enough to let voice coil 42 travel without interference. Other forms of top plate can be made, whether plates of relatively great thickness, with a taper or chamfer toward the inner edge, such as used in an over hung speaker, or relatively thin plates having a flange formed at their inner edge, such as used in an under-hung speaker.

Typically, back plate 66, top plate 68, and pole piece, or post 70, are made of a materials of high magnetic permeability, such as a iron, steel or other ferrous alloy, or a nickel or cobalt alloy, or similar material. Most commonly they are made of iron or steel. When mated with magnet 62 they combine to form a magnetic flux path assembly, or magnetic circuit, that is complete but for a gap between the inner annular face 67 of top plate 68 and adjacent distal region 78 of post 70. This gap, indicated as 80, is sized to accommodate movement of voice coil 42. One of the factors determining the overall efficiency of the speaker is the size of air gap 80. Since the reluctance of the metal members is very much smaller than the reluctance of air gap 80, it is desirable that air gap 80 be as small as possible without interfering with the free movement of voice coil 42, allowing for manufacturing tolerances in the size of voice coil 42, in the inside diameter of face 67, and in the manufacture of the diaphragm assembly 22 generally.

Frame 24 is mounted to magnet assembly 60 by a footing 82. When a time varying voltage is applied across terminals 52 and 54 voice coil 42 will move in the direction of axis 40 through the magnetic field prevailing across gap 80. Inasmuch as bobbin 36 is rigid, any displacement of voice coil 42 will be matched by an equal translation of conical diaphragm member 22. The limit of this motion will be determined by the time varying signal applied, and by the suspension. In due course the suspension will return the diaphragm assembly to its initial position.

A voice coil cavity, or diaphragm cavity 84 is defined as the open space within voice coil 42 bounded by the inner surface of the sealed central membrane of the diaphragm, that is, dust cap 58, lying beyond the end face 85 of distal end 78 of the pole piece, post 70. The outer cylindrical boundary of cavity 84 is the inner wall of bobbin 36. The mean, or reference volume of cavity 84 is, in general, its volume at rest. Inasmuch as top plate 66 is annular, it lies entirely outside, that is, external to, bobbin 36, voice coil 42, and cavity 84. The volume of cavity 84 is not constant over time, but varies with the displacement of dust cap 58. Since dust cap 58 is, as noted, a sealed membrane; motion of bobbin 36 carrying voice coil 42, and hence conical diaphragm member 22 results in the displacement of a volume of air along bore 74 of post 70. In operation at low volumes and moderate frequencies, the volumetric displacement is relatively small. However, typically at lower frequencies yielding large translations of voice coil 42, the volume of air displaced may be significant relative to the overall volume of cavity 84. This displacement of dust cap 58 results in an exchange of air through bore 74. If bore 74 is closed, motion of voice coil 42 will tend to cause a compression (or expansion) effect since motion of dust cap 58 would tend to compress (or expand) the air in cavity 84, and in bore 74, however large its enclosed volume may be.

Another enclosed space 90 is defined within a round cylindrical inner surface 92 of annular magnet 62, and the outer surface 94 of the pole piece, post 70. This space is capped at either end by top plate 66 and backplate 64. Since gap 80 is relatively small, rapid displacement of bobbin 36 and voice coil 42 will tend to compress (or expand) the air trapped in space 90.

In terms of the magnetic flux path assembly described above, the magnet need not be the annular disc, but could be any of the elements, whether post 70, top plate 66, back plate 64, or, as shown, magnet 62, provided that there is a magnetic element of some kind in the magnetic circuit at some location. Similarly, the precise geometry of top plate 66 and post 70 can be varied. In general, there is a pole piece of some kind, a magnetic flux land adjacent to the pole piece, and a connecting member, whether made up of a single part of several parts joined together, that provides a relatively high magnetic permeability path between the flux land and the pole piece. The term high magnetic permeability is used in contrast to the magnetic permeability of the air gap, which is several orders of magnitude lower.

When low frequencies (bass) are applied to the woofer, the cone moves away from the magnet, or toward the magnet, depending on polarity. The frequency dictates how often per second the cone moves, and the magnitude of the voltage will determine the amplitude of the displacement against the restoring force of the suspension. When high power bass is applied, the woofer described above uses dust cap 58 to pump air through the vent, that is, the airflow passage, formed by bore 74 and the corresponding opening 76 in backplate 66. The motion of dust cap 58 causes cool air to be sucked in, and warmed air to be blown out through the back of magnetic assembly 60. This tends to provide some cooling for the pole piece.

Figure 2:
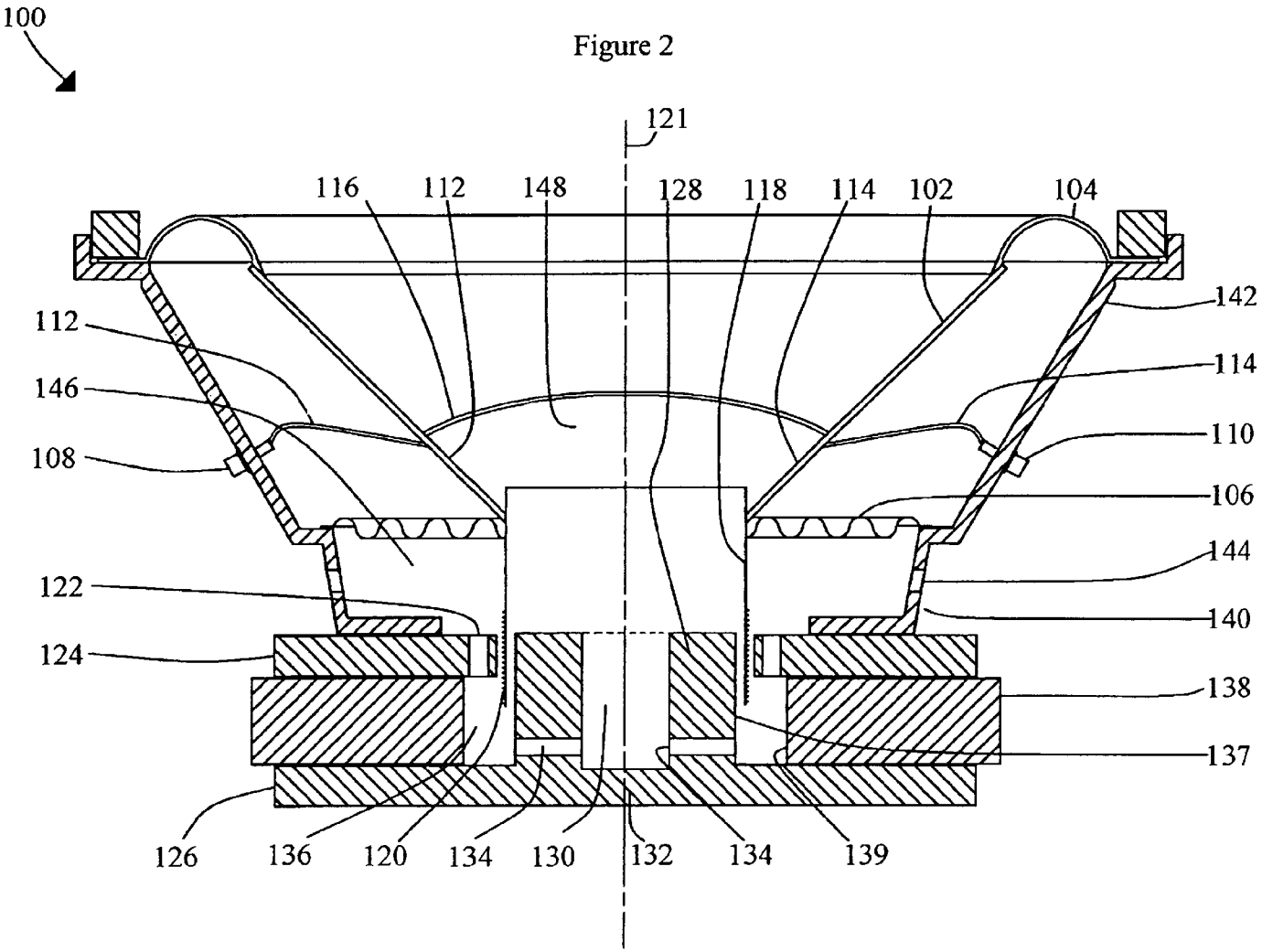
FIG. 2 is a cross sectional view of an example of a loudspeaker assembly according to the principles of the present invention.

Referring to FIG. 2, another loudspeaker is shown in cross-section, and indicated generally as 100. It has a conical diaphragm member 102, upper and lower suspension members 104 and 106, terminals 108 and 110, lead wires 112 and 114, a dust cap 116, a bobbin 118 and a voice coil 120, arranged in generally the same fashion as noted above. Unless stated otherwise, these and other parts have generally the same construction and physical properties of the corresponding elements illustrated and described in the context of FIG. 1. The central axis of loudspeaker 100, which is also the axis of reciprocation of voice coil 120, is indicated as 121.

An array of ventilation ports, or passages 122, have been let through top plate 124. Passages 122 can be formed in top plate 124 by being drilled, punched, pierced, cast, or formed by other conventional means. Although a single passage could be used, a symmetrical array of four passages on 90 degree centers about voice coil 120 is preferred. Passages 122 should have dimensions chosen to avoid, or discourage, whistling over the operational range of loudspeaker 100 generally.

Notably, back plate 126 does not have a central opening, but rather, the pole piece, that is, central post 128, has a bore 130 that has a closed end 132 closed at back plate 126. Vents, in the nature of lateral passages 134, permit fluid communication between bore 130 and an annular chamber, or space 136 that lies about the exterior wall 137 of post 128, and within the interior wall 139 of annular magnet 138 (which wall, 139 defines the eye of magnet 138), and corresponds generally to space 90 described above. Also the lower portion 140 of basket, or frame 142 has perforations 144 such that the otherwise enclosed space, or chamber, 146 that lies between top plate 124 and lower suspension member 106 is vented to ambient. Although it is preferred to perforate lower portion 140 in this way, it would be possible to vent lower suspension member 106 to permit fluid communication to ambient as well.

Inasmuch as the clearance between bobbin 118 and post 128 is very small, displacement of voice coil 120, and consequent displacement of the other members of the diaphragm assembly, will tend to force air to be displaced from (or to) cavity 148 under dust cap 116 (corresponding, generally, to cavity 84), forcing some air to flow through passages 134 and, in turn, through passages 122 and perforations 144. Large, low frequency displacements may tend to have the most pronounced effect in terms of air displacement.

In general use, the heating of voice coil 120 in use tends also to warm top plate 124 and post 128. The exchange of air through the passages indicated as items 122, 134, and 144 tends to promote cooling of top plate 124 and post 128. This also tends to promote cooling of voice coil 120, with the result that loudspeaker 100 may tend to operate at a lower temperature than otherwise. Since voice coil 120 remains cooler, the increase in impedance of the coil due to heating may tend to be less than it might otherwise be, and the overall performance of the speaker may tend to be correspondingly improved. In effect, a relatively smaller loudspeaker may tend to be able to perform at a higher power level that would otherwise suggest the employment of a larger, possibly heavier and more expensive, loudspeaker unit.

The size and number of openings let through top plate 124 is neither so numerous nor so large as to detract significantly from thermal conduction in top plate 124. Since the velocity of the air is greatest at the apertures, passages 122, and since an exchange of hot air for cooler ambient air is promoted, the apertures may tend to be locations of relatively high convection heat transfer from top plate 124. It is preferred that these apertures be smoothly radiused to discourage whistling.

Notably, loudspeaker 100 illustrated in cross-section in FIG. 2 does not employ an aerodynamic vane or body in bore 74, and as shown, does not employ complex channels of changing diameter or taper, although it could do. Although air communication passageways need not be straight, and could be formed at an angle, or on a taper, in dogleg form, or in a curved form and could have flared, rounded, or chamfered ends to reduce air noise, it is nonetheless preferred that the passages in post 70 be capable of fabrication by drilling or punching, or otherwise forming, as straight bores of constant diameter or slots of constant thickness, and that the openings in top plate 124 be formed by a similarly direct method to tend to reduce the cost and complexity of manufacture.

Figure 3:
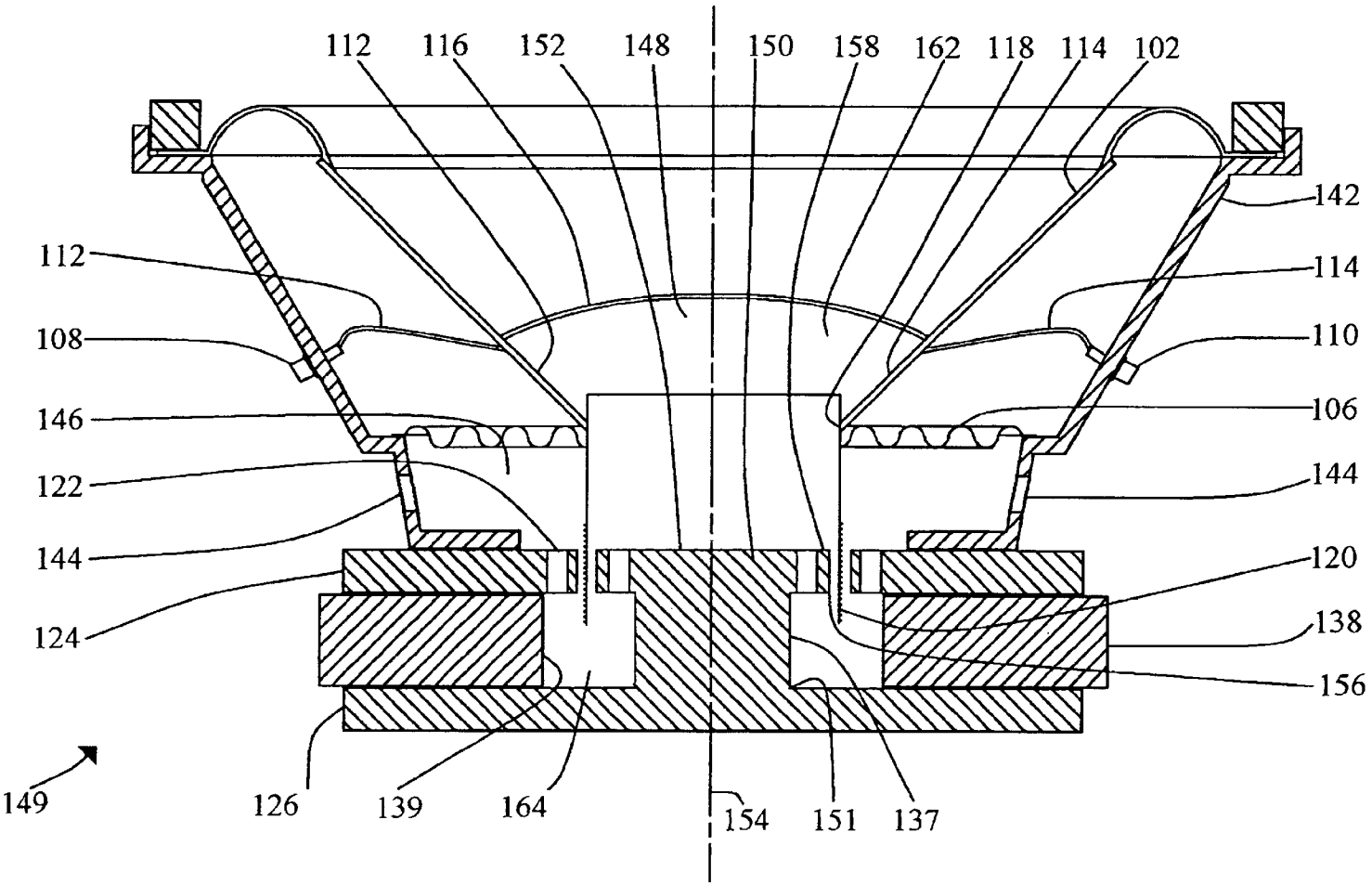
FIG. 3 shows an alternative embodiment of loudspeaker assembly to the assembly of FIG. 2 having an undercut pole piece.

In the alternative embodiment of FIG. 3, parts that are the same as indicated in the context of the loudspeaker of FIG. 2 are given the same identifying item numbers. The embodiment of loudspeaker of FIG. 3, indicated generally as 149, differs from that of FIG. 2 in that the pole piece, 150, is a solid pillar having a narrow end 151 mounted to backplate 126, and a widened distal end 152 about which voice coil 120 rides. The central axis is indicated as 154. Pole piece 150 has a medial shoulder 156 such that distal end 152 has an overhang relative to narrow end 151. Medial shoulder 156 forms a transition wall between outer wall 155 of narrow end 151 and outerwall 157 of distal end 152. Distal end 152 also has a distal end face 158 facing dust cap cavity. An array of straight through bores 160 each running parallel to axis 154 has been formed between face 158 and the annular face of shoulder 156. The array can have any number found suitable to permit passage of air from cavity 162 beneath dust cap 116 and space 164 lying about pole piece 150 within magnet 136, without noticeable whistling over the operational range of loudspeaker 148.

Figure 4A:
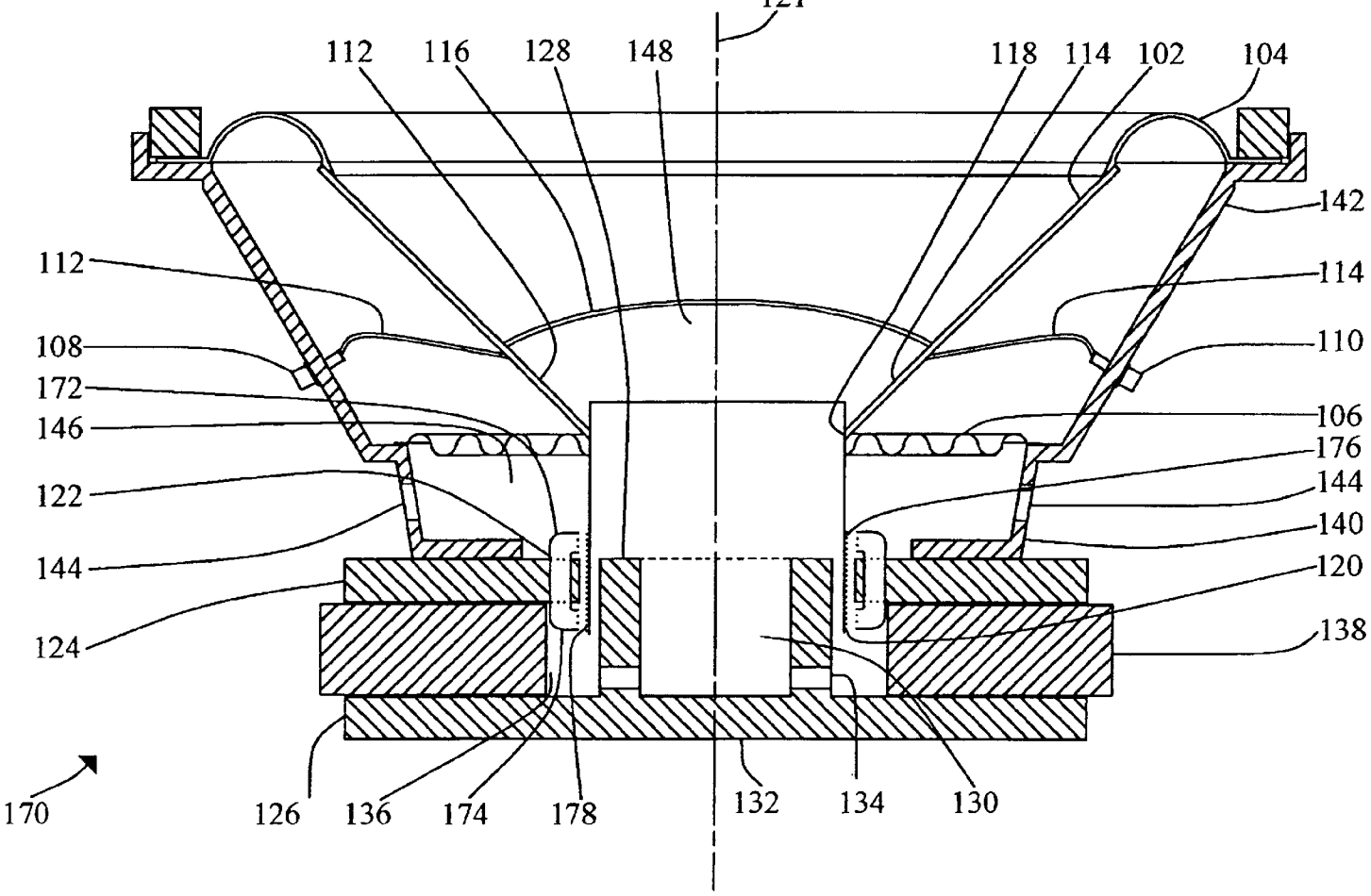
FIG. 4*a*, shows another alternative to the loudspeaker of FIG. 2, in which air guides are mounted to direct air traversing the top plate.

In the alternative embodiment of FIG. 4*a*, parts that are the same as indicated in the context of the loudspeaker of FIG. 2 are again given the same identifying item numbers. A loudspeaker is indicated generally as 170. It differs from that of FIG. 2 in air deflectors in the nature of vanes 172, 174 are shown mounted to each of passages 122 in top plate 124. Vanes 172 and 174 are intended to promote enhanced heat transfer by convection from the end regions 176 and 178 of voice coil 120. Vanes 172 and 174 could be formed as duct elbows, as shown, or as airfoils, or as deflector plates for imparting an inward radial component of momentum to the air displaced through top plate 124, such that air discharged from either vane 172 or 174 will tend to have a component of velocity toward voice coil 120, whether that velocity is directly radially inward with little or no tangential component, or whether, as is alternatively possible, there is a significant tangential component of velocity relative to voice coil 120 (that is, whether the vanes are angled to give a circumferential component of velocity as well). Similarly, the intake of vanes 172 and 174 is adjacent to regions 176 and 178 of voice coil 120, to tend to encourage a higher rate of air exchange in those regions for encouraging improved heat transfer.

The inventor has noted that when loudspeaker elements are driven by too strong a signal, or by a clipped signal, at terminals 108 and 110 regions 176 and 178 tend to be the regions of voice coil 120 most prone to burn out prematurely. Vanes 172 and 174 may tend to enhance the tolerance, or the endurance, of regions 176 and 178 for operation under such conditions.

Figure 4B:
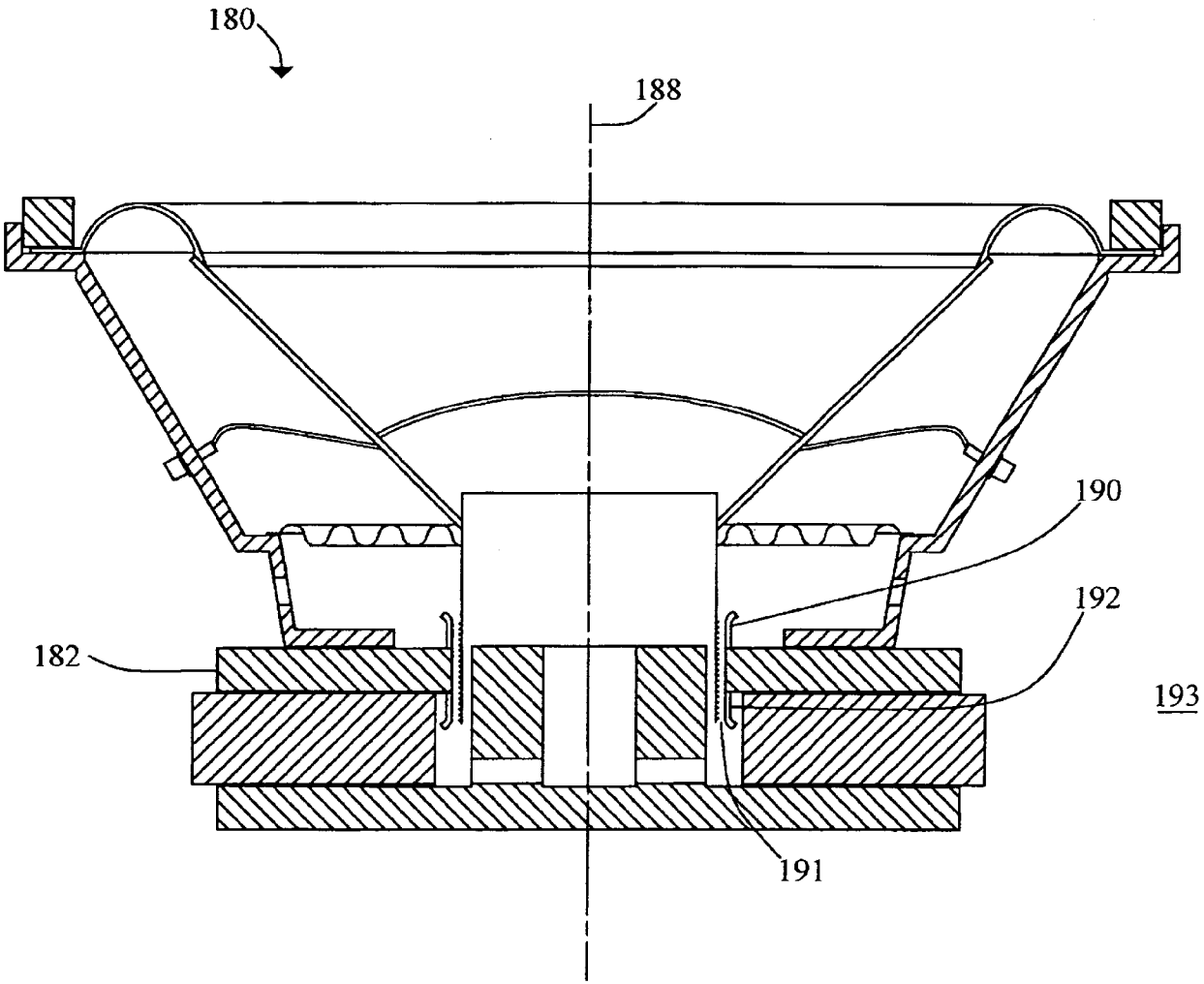
FIG. 4*b*, shows an alternative vane arrangement to the loudspeaker of FIG. 4*a;*
Figure 4C:
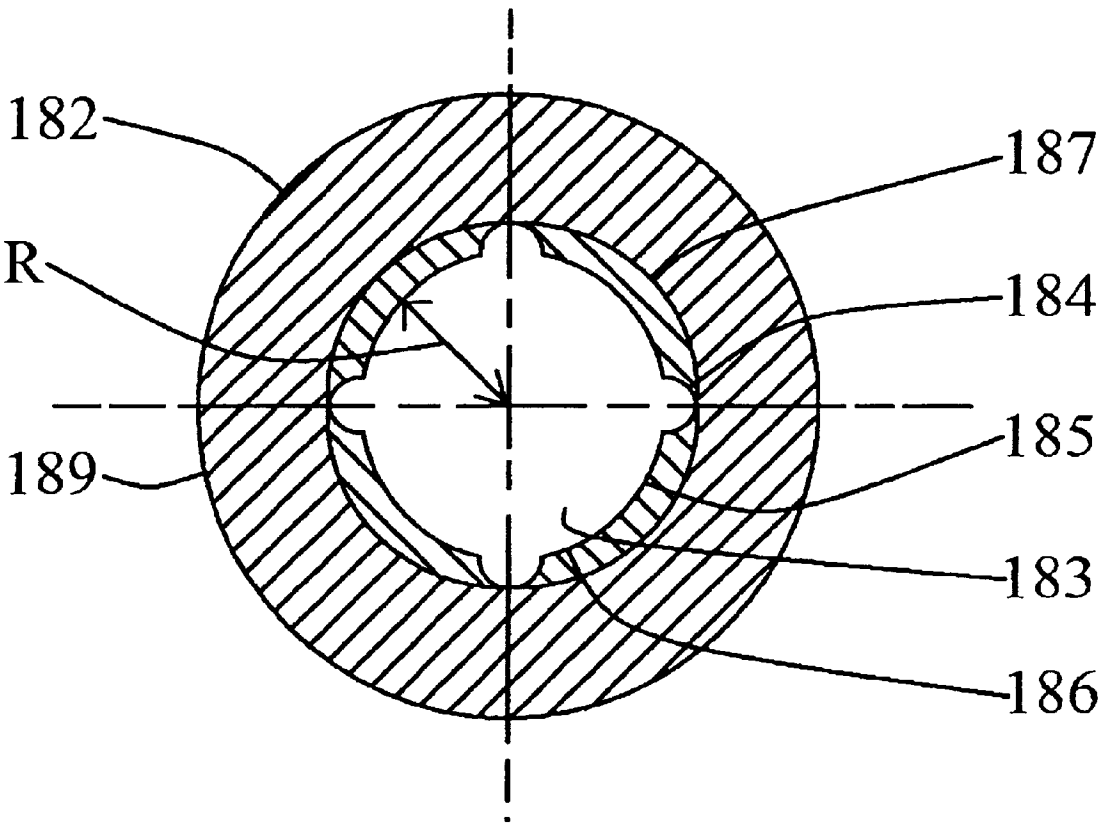
FIG. 4*c* shows a plan view of a top-plate for the loudspeaker of FIG. 4*b;*

FIG. 4*b* shows an alternative loudspeaker 180. It is similar to loudspeaker 170, except insofar as it has a top plate 182 having an array of reliefs or notches 184 in the nature of roughly semi-circular cusps defined in plate 182 spaced about its inner edge 186, rather than having holes formed through its main portion generally. As illustrated there are 7 notches on equal degree centers about axis 188, notches 184 being spaced apart by portions 185 of the closed inner periphery 187 of plate 182 that defines opening 183 in plate 182. Portions 185 are sectors of a circular arc, concentric about axis 121 at a radius indicated as 'R'. Plate 182 also has a circular outer periphery 188 that is concentric with portions 185 and pole piece, or post, 128. Gap 191 is defined between portions 185 and post 128. Notches 184 provide venting through plate 182 to permit displacement of air between enclosed space 136, and external ambient 193. Corresponding vane arrays 190 and 192 are mounted to extend from either side of top plate 182, to channel the air displaced by the motion of dust cap 116 along the face of voice coil 120 in the angular intervals corresponding to the location of notches 184. FIG. 4*c* is a plan view of top plate 182 showing the distribution of notches 184.

In an alternative embodiment, the alternative, solid, undercut pole piece, 150 of FIG. 3 could be used with loudspeaker 170 of FIG. 4*a* or 4*b*.

Figure 5A:
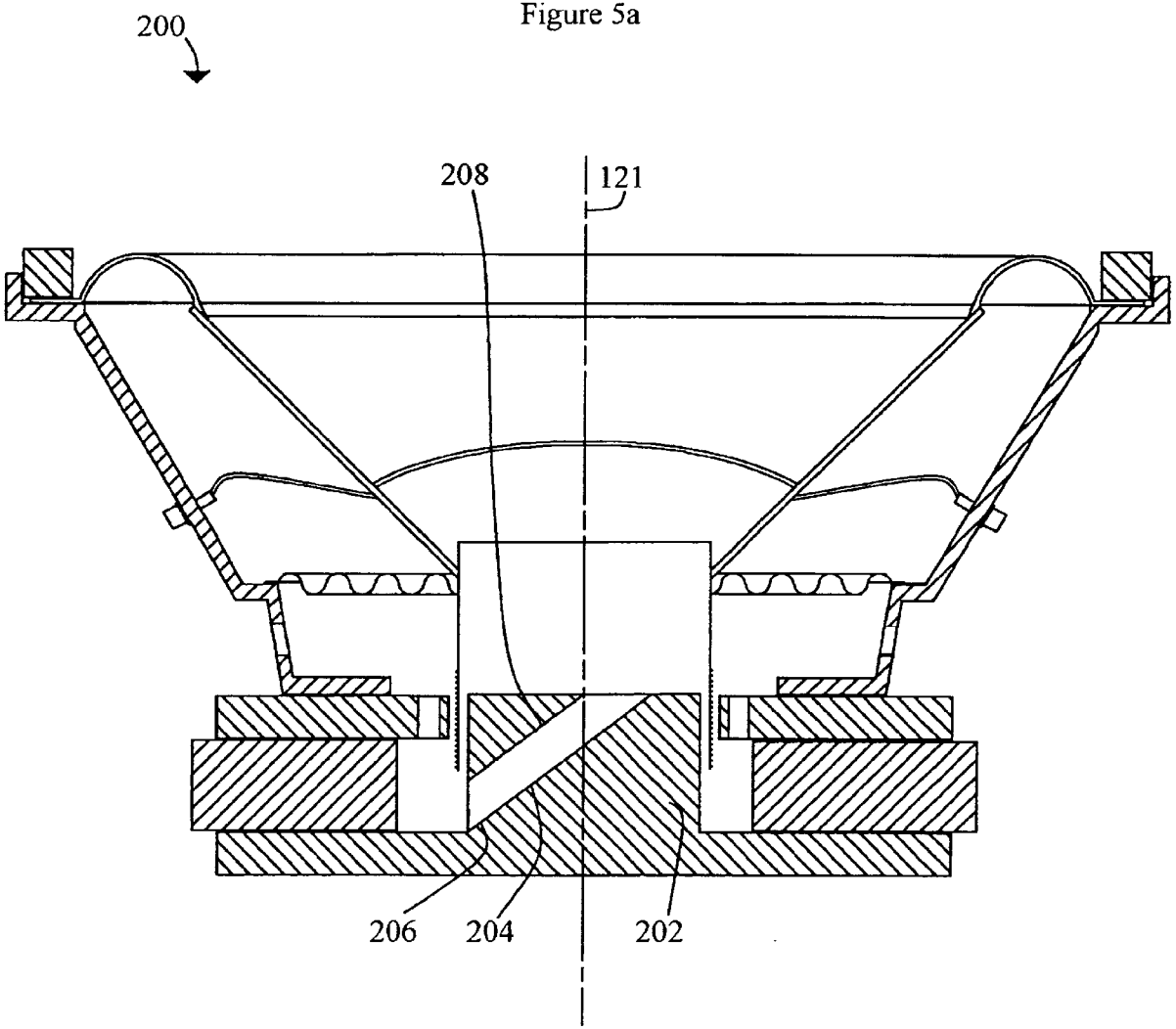
FIG. 5*a* shows a cross-section of an alternative to the loudspeaker of FIG. 2 having an angular air communication passage.

In the alternative embodiment of loudspeaker 200 illustrated in FIG. 5*a*, pole piece 202 has an angled passageway 204. An angled passageway, having one side 206 longer than the other 208, may tend to discourage resonance phenomena.

Figure 5B:
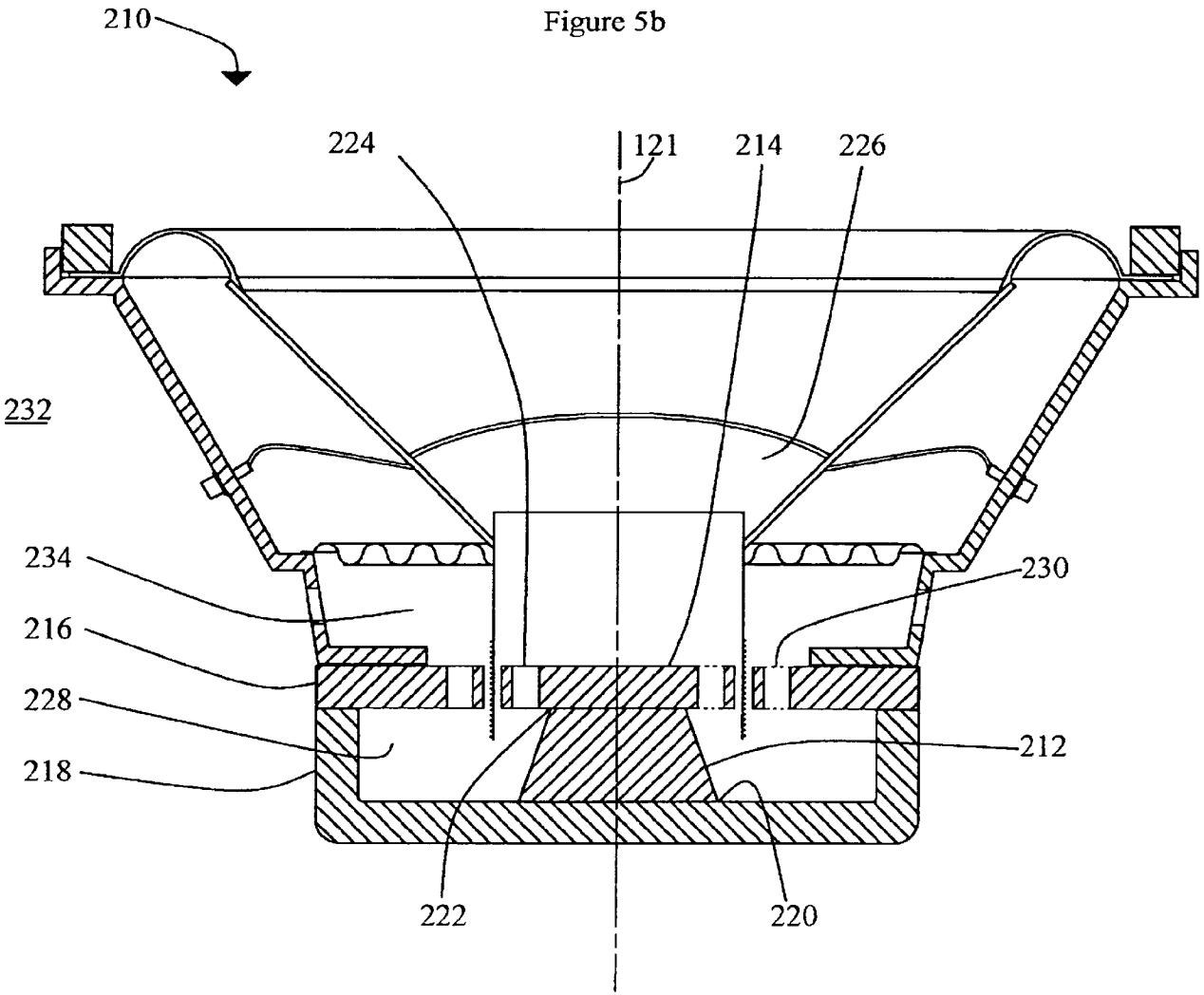
FIG. 5*b* shows a cross-section of another alternative to the loudspeaker of FIG. 2, in which the pole piece is a tapered magnet having a vented cap.

In the alternative embodiment of FIG. 5*b*, a loudspeaker 210 is shown having a magnet 212 in the form of a pole piece, with a cap 214, a top plate 216, and support structure such as a linking member in the form of a ferro-magnetic cup 218. Magnet 212 is mounted centrally on cup 218, and is tapered from a relatively wide base 220 to a distal narrower end 222. That is, magnet 212 is a truncated conical section. Cap 214 is a round disc that has passages 224 formed in it to permit air to be displaced between cavity 226 and internal space 228. As before, top plate 216 has passages 230 to permit displacement of air between space 228 and external ambient, indicated generally as 232, through openings in the basket or spider, or both, or through a similar passageway or groove, or space formed to permit airflow between the space indicated as 234 and ambient 232.

Figure 6A:
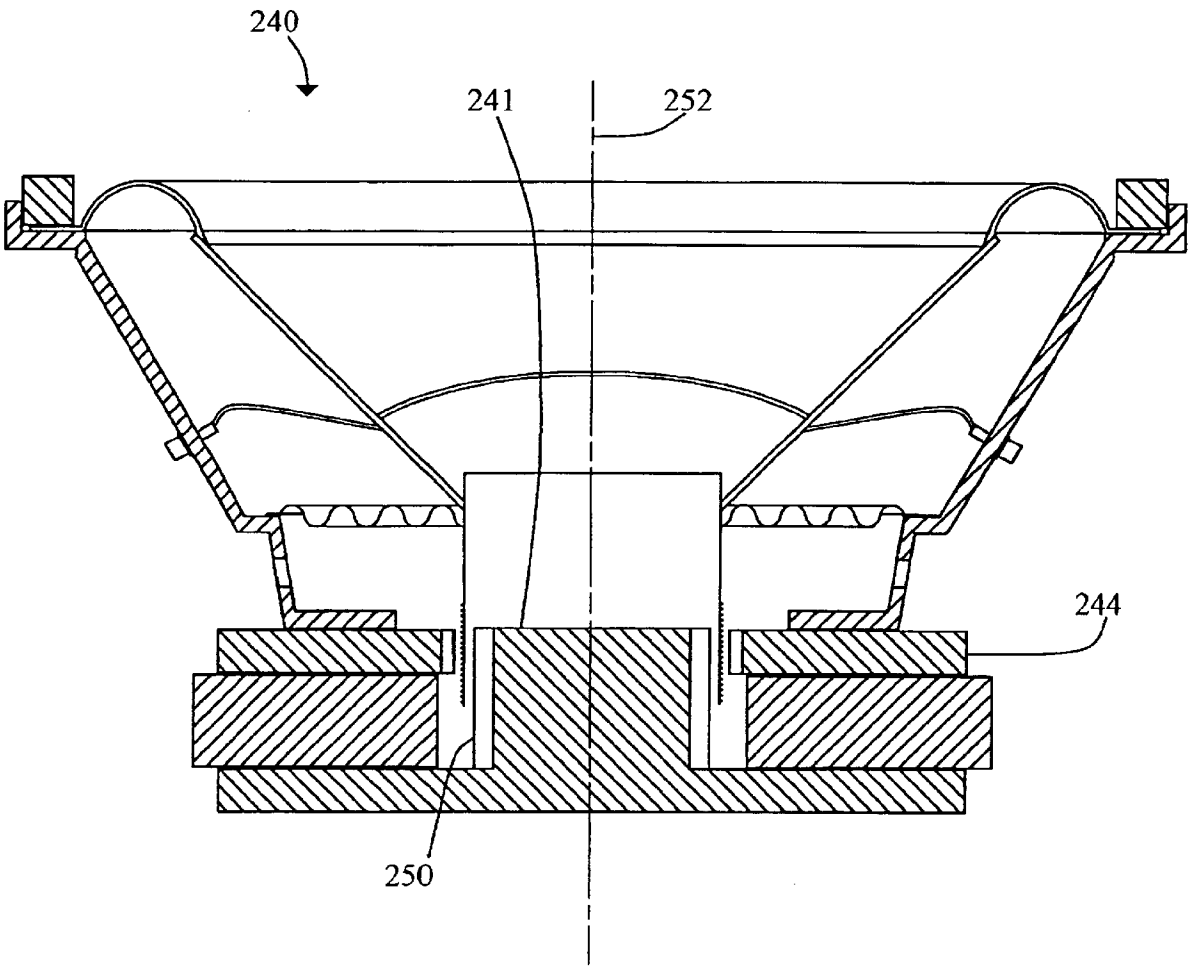
FIG. 6*a* is a cross-section of an alternative to the loudspeaker of FIG. 2 in which channels are provided adjacent to the voice coil.
Figure 6B:
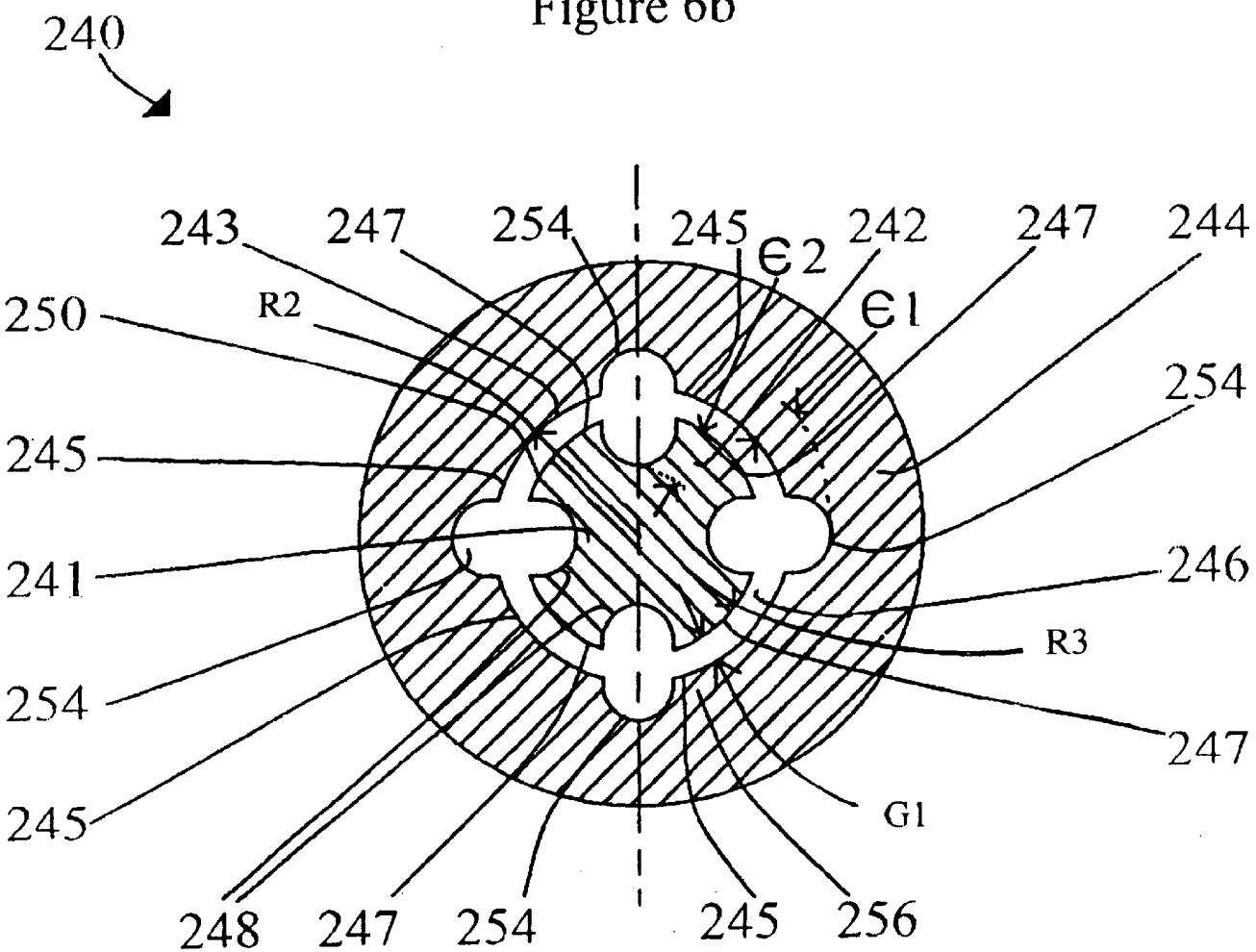
FIG. 6*b* is a top view of the magnet assembly of the loudspeaker of FIG. 6*a;*

In the alternative embodiment of FIGS. 6*a* and 6*b*, a loudspeaker 240 has a pole piece 242 and a top plate 244. The space between them is indicated as 246. Pole piece 242 has an array of four vertical channels 248 formed on ninety degree centers in its external face 250 parallel to central axis 252 of loudspeaker 240. Pole piece 242 does not have a hollow center passage for conducting air in this example. Four semi circular notches, or rebates or reliefs, or bights 254 are punched in top plate 242 each being formed opposite one of channels 248. Reciprocation of voice coil 120 will tend to cause air to be displaced in one direction in channels 248 parallel to axis 252, and in the other direction through bights 254. The critical gap dimension, indicated by A remains the distance between the remaining flux lands 256 of top plate 242 and the arcuate portions of pole piece 242 lying on its outer diameter. That is, space 246 is defined, on one side by the external side wall face 250 of the distal end region 241 of pole piece 242 opposite the opposed flux land 256 of the opposed member, top plat) 244. The other side of space 246 is defined by the closed inner peripheral wall 243, or face, of top plate 244. Peripheral wall 243 has portions, namely sectors 245, that are sectors of a circular arc, all of sectors 245 being concentric about axis 252 and lying at a radius $R_2$ therefrom. Peripheral wall 243 also has reliefs in the nature of bights 254 that extend outwardly of radius % a distance indicated as M.

It will be noted that vertical channels 248 of pole piece 242 are interspersed with arcuate sectors 247 about distal end region 241 of pole piece 242. Sectors 247 are circular arcs concentric about axis 252, and lie at a radius $R_3$ therefrom. Channels 248 extend radially inward of radius $R_3$ a distance indicated as $M_2$.

Gap 'G' is defined between sectors 247 and 245. Sectors 247 and 245 channels 248 and bights 254 are all in the form of arrays arranged equally and symmetrically about planes intersecting axis 252.

Neither bights 254 nor channels 248 need be formed in a semi-circular, or circular arc shape, but could be splines such as V-notches, keyways such as three-sided square notches, tapered notches, or some other form. Where such channels are used, the more-or-less semi-circular arcs shown are preferred. Channels 248 need not extend to the point at which the base 256 of pole piece 242, but merely far enough to provide a clear passage past the most distant extremity of bobbin 118 from dust cap 116, at its maximum excursion toward back plate 126. Where used, it is preferred that channels 248 extend parallel to axis 252. However they could be skewed or inclined with respect to axis 252, such as to form a helical pathway or groove in the sidewall face of pole piece 242.

In alternate embodiments, a pole piece, such as pole piece 242 could be used in conjunction with a top plate lacking bights 124, but having passages such as passages 132 of top plate 124, or, alternatively, a top plate having notches, such as bights 124 could be used in conjunction with the pole piece of any of FIGS. 2, 3, 4*a*, 4*b*, 5*a* or 5*b*.

It is not necessary that the opening in the top plate have a round, that is, circular form, or that it be a closed periphery, although this is preferred. The shape of the opening or slot in the top plate does correspond to the shape of the pole piece in cross-section, and to the shape of the voice coil in cross section, to define the gap width, such as the width 'G' described above. The general shape of the opening, whether in the context of FIGS. 2, 3, 4*a*, 4*b*, 5*a* or 5*b*, could be round, triangular, oval, elliptical, square, hexagonal, star shaped, or some other arbitrary shape such as may be chosen. Similarly, the sectors of the circular arcs need not be concentric about a common axis, and need not be circular sectors.

Figure 7:
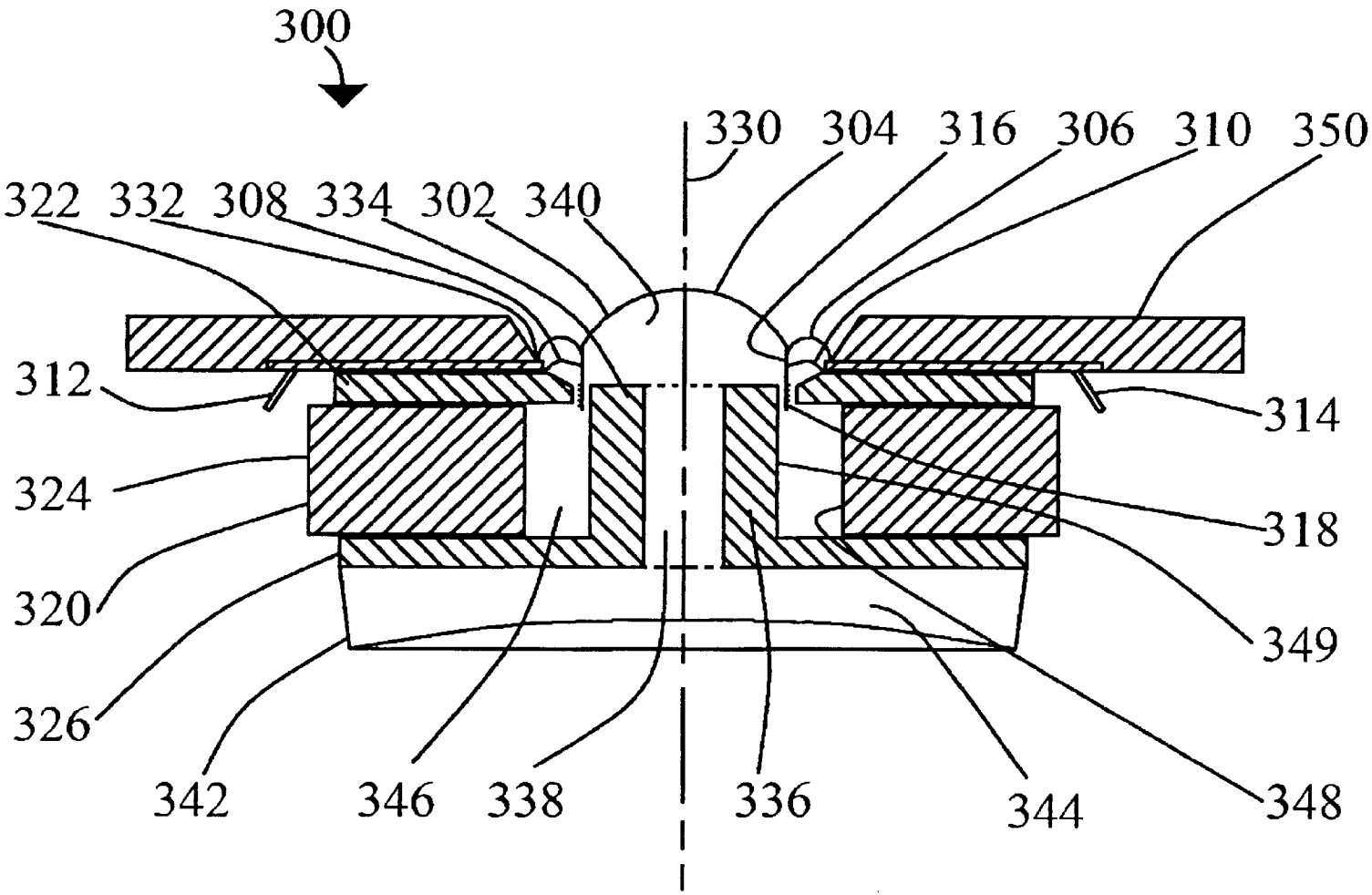
FIG. 7 is a cross-section of a prior art closed cup tweeter.

FIG. 7 shows a tweeter 300 of conventional design with a diaphragm assembly 302 having a dome membrane 304, a resilient suspension 306 surrounding the dome, a pair of leads 308, 310 leading, respectively to terminals 312 and 314, a bobbin 316 and a voice coil 318 formed on bobbin 316. Tweeter 300 also has a magnetic assembly 320 having a top plate 322, an annular magnet 324, and a backplate 326. The central axis of tweeter 300 is indicated as 330. Top plate 322 is annular, and has an inner, chamfered edge and a flux land 332 opposite the distal end 334 of pole piece 336 mounted to backplate 326. Pole piece 336 is hollow, having a central bore 338 extending from a cavity 340 under dust cap, or dome membrane 304 fully through back plate 326.

Notably, the back of tweeter 300 is closed off by a backshell, or cup, 342. The internal volume 344 of cup 342 is large relative to the volume of cavity 340, such that air pressure variations under membrane 304 do not interfere excessively with operation of tweeter 300 generally. In practice volume 344 of cup 342 tends to be chosen by the speaker designer to provide an optimum operating resonance condition at the design point of the tweeter, and to provide acceptable performance over the tweeter operating range to either side of the design point.

Also shown in FIG. 7 is a space 346 defined between the circular inner face 348 of annular magnet 324, the outer face 349 of pole piece 336, top plate 322, and backplate 326. This space, or chamber, or enclosed volume, is analogous to space 90 described above. In tweeter 300 shown in FIG. 7, a face plate 350 mounts diaphragm assembly 302 to magnetic assembly 320. There is neither venting through top plate 322 nor through back plate 326 in communication with space 346.

Figure 8A:
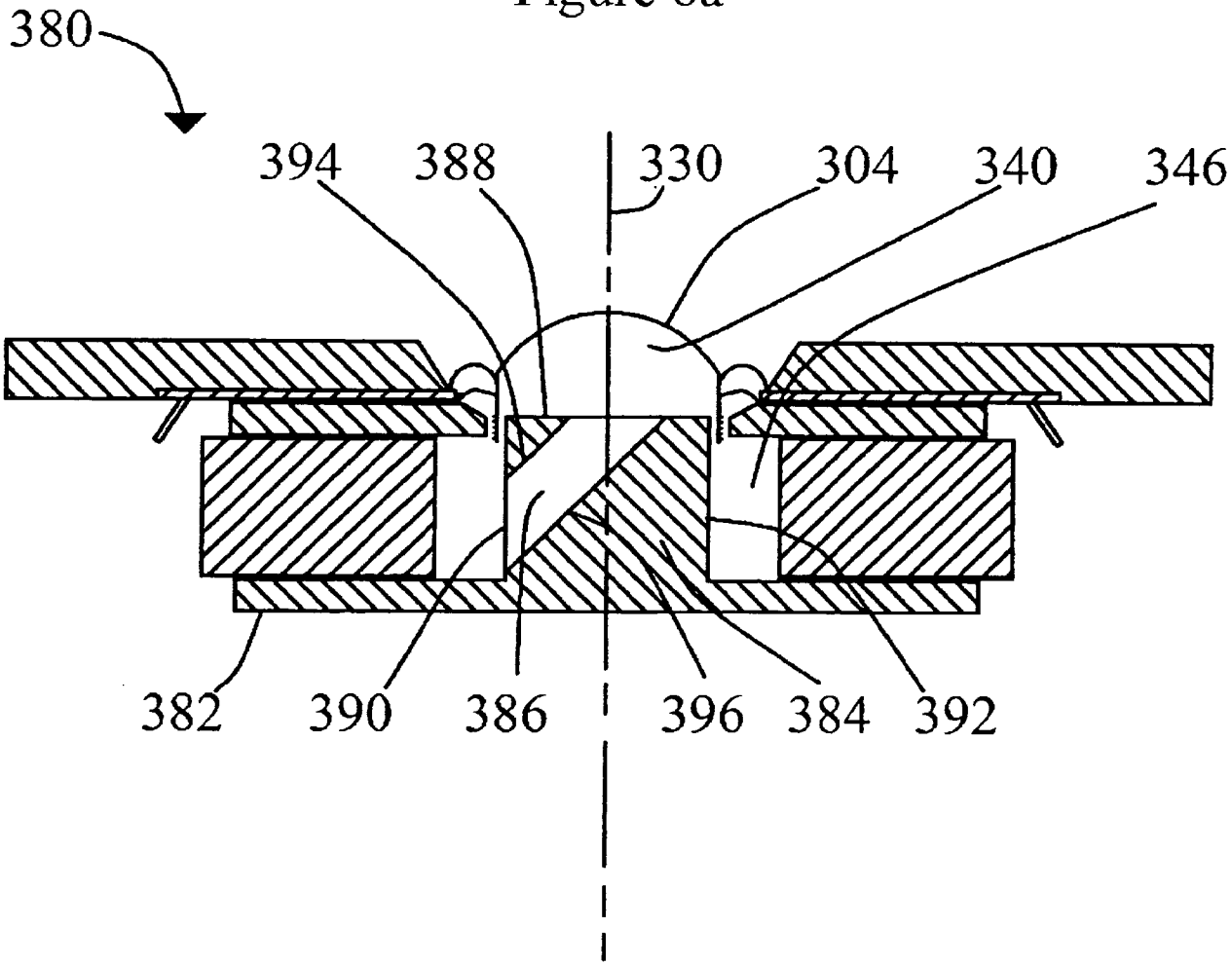
FIG. 8*a* shows a tweeter with a pole-piece vented inside the magnet.

FIG. 8*a* shows a tweeter 380. Again, common parts with tweeter 300 are indicated by common item numbers. Tweeter 380 does not have a central bore, and backplate 382 is imperforate. That is, backplate 382 does not have a communicating passageway for permitting air to enter or exit tweeter 380. Tweeter 380 has a pole piece 384 that has a passage 386 defined in it extending between distal face 388 of the distal end portion of pole piece 384 and a port 390 located on the trunk, or circular sidewall 392 of pole piece 384 to give onto space 346. As shown, displacement of dome membrane 304 parallel to axis 330 will tend to compress or expand the air not only in cavity 340 under dust cap dome membrane 304, but also the volume of air entrapped in space 346. The elimination of cup 342 tends to reduce the depth, and the overall enclosure envelope, of tweeter 380 as compared to tweeter 300. The inclination of passage 386 and the inequality of length of its sides 394 and 396 tends to give a different, and preferred, frequency response characteristic to that obtained with the passage shown in FIG. 7. Passage 386 of FIG. 9*a* need not be round, or straight, but could vary in shape, angle, aspect ratio, or cross-sectional area.

Figure 8B:
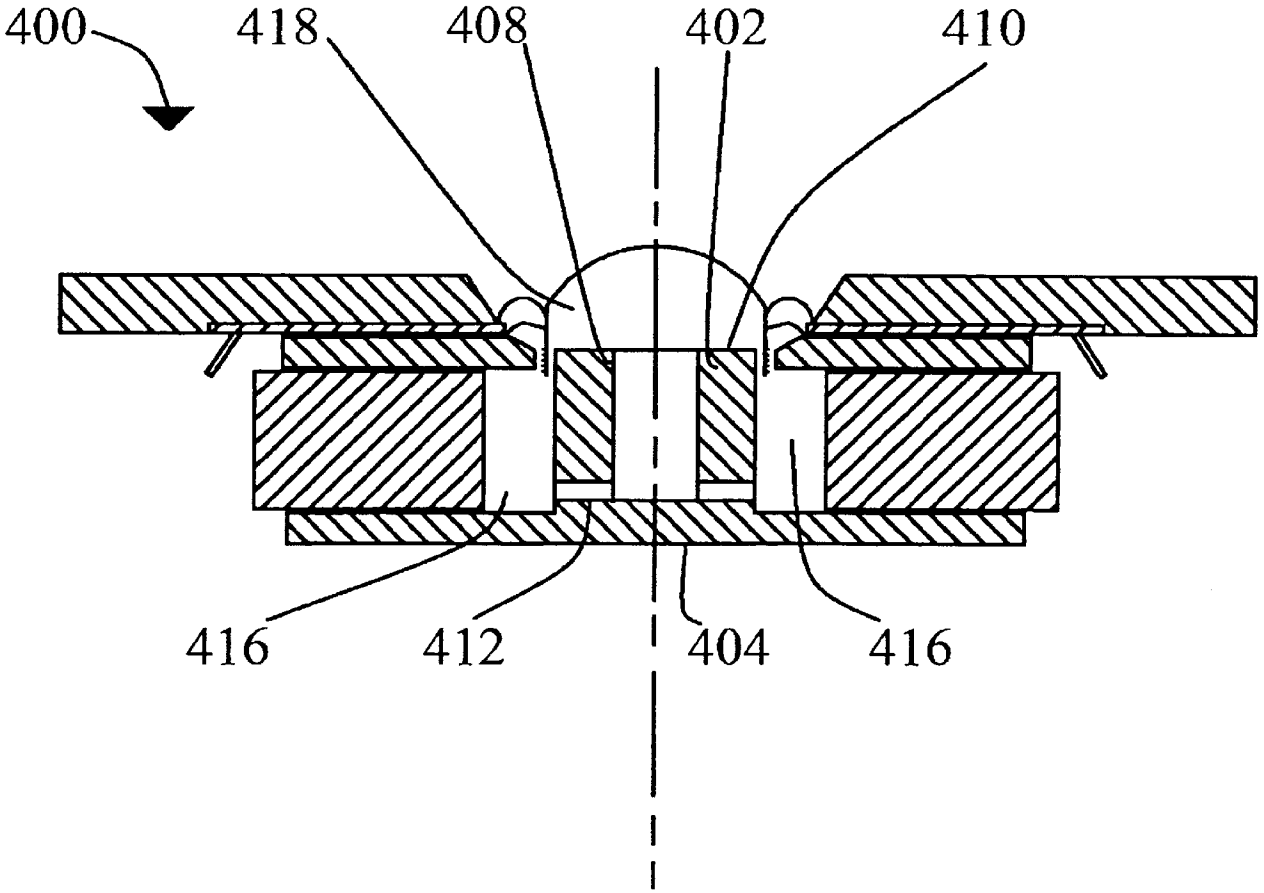
FIG. 8*b* shows an alternative embodiment of the loudspeaker of FIG. 8*a*.

FIG. 8*b* shows a cross-section of a tweeter 400. In this embodiment a pole piece 402 is provided having an obstructed, or capped end 404 at backplate 406, and a well, in the nature of a blind bore 408 extending inwardly from its distal end 410. A cross bore 412, shown as having a smaller diameter, is formed, typically by drilling, across the trunk 414 of pole piece 402 to intersect bore 408 at its profound end. Cross-bore 412 is open at either end to space annular 416 such that a path of fluid communication is established between space 416 and cavity 418 under dust cap dome membrane 420. In this way, reciprocation of membrane 420 will again cause compression and expansion not only of the volume of cavity 418 but also of space 416. Again, tweeter 400, like tweeter 380, does not employ a backshell, or cup such as cup 342.

Various embodiments of the invention have now been described in detail. Since changes in and or additions to the above-described best mode may be made without departing from the nature, spirit or scope of the invention, the invention is not to be limited to those details, but only by the appended claims.

I claim:

1. A loudspeaker comprising:

a closed-backed magnetic flux path assembly;

the magnetic flux path assembly having a pole piece, a magnet, a magnetically permeable front plate, and a magnetic flux path between one pole of the magnet and the pole piece and between the other pole of the magnet and said front plate;

said front plate having an opening defined therein sized to fit about the pole piece and to cooperate with the pole piece to define a gap;

a diaphragm, a voice coil mounted to said diaphragm, said diaphragm being driven by said voice coil, said voice coil being mounted in said gap;

said gap accommodating movement of said voice coil;

said diaphragm having a central dust cap;

an enclosed cavity being defined within said voice coil and between said dust cap and said pole piece;

said magnetically flux path assembly having an enclosed space defined therein about said pole piece;

said pole piece having a passageway defined therein, said passageway providing a fluid communication path between said cavity and said enclosed space; and said front plate has venting defined therein external to the voice coil, said venting permitting fluid communication to ambient from said enclosed space through said plate external to the voice coil.

2. The loudspeaker of claim 1 wherein said front plate has an outer periphery, an inner periphery defining said opening, and said venting is segregated from said inner periphery.

3. The loudspeaker of claim 2 wherein said front plate has the form of a disc in which said inner and outer peripheries are circular and concentric.

4. The loudspeaker of claim 3 wherein said venting includes an array of apertures spaced outwardly from, and having a pitch circle concentric with, said inner periphery.

5. The loudspeaker of claim 4 wherein said apertures are circular.

6. The loudspeaker of claim 1 wherein said opening has a periphery, a portion of said periphery being formed on an arc of a circle, said arc having a radius, and said venting includes at least one rebate let into said periphery, and extending radially outwardly further than said radius.

7. The loudspeaker of claim 1 wherein said opening has a crenellated profile.

8. A closed-backed magnetic flux path assembly for a loudspeaker having a diaphragm, the diaphragm having a dust cap member, a voice coil for driving the diaphragm and a dust cap cavity defined therewithin, wherein:

said magnetic flux path assembly has a pole piece, an opposed member placed in spaced relationship from the pole piece to define a gap for accommodating reciprocation of the voice coil, and at least one intermediate member mounted to maintain the position of said pole piece and said opposed member relative to each other;

said pole piece, said intermediate member, and said opposed member co-operating to form a continuous path of higher magnetic permeability than said gap;

at least one of said pole piece, said at least one intermediate member, and said opposed member includes a magnet for establishing a magnetic flux in said magnetic flux path assembly and across the gap;

said magnetic flux path assembly has an airflow path defined therein extending between the dust cap cavity and external ambient, for permitting displacement of air between the cavity and external ambient;

said pole piece has a passageway defined therein;

at least a portion of said airflow path is defined in said opposed member external to said gap;

said dust cap cavity being in fluid communication with said passageway defined in said pole piece;

said passageway defined in said pole piece being in fluid communication with said portion of said airflow path defined in said opposed member;

whereby motion of the diaphragm causes displacement of air in said passageway in said pole piece and in said portion of said airflow path defined in said opposed member.

9. The magnetic flux path assembly of claim 8 wherein said opposed member is a plate having an outer periphery, a closed inner periphery defining an opening extending about said pole piece, said gap lying between said periphery and said pole piece, and said portion of said airflow path is formed in said plate and is segregated from said opening.

10. The magnetic flux path assembly of claim 9 wherein said plate has the form of a disc in which said inner and outer peripheries are circular and concentric.

11. The magnetic flux path assembly of claim 10 wherein said portion of said airflow path formed in said plate includes an array of apertures spaced outwardly from, and having a pitch circle concentric with, said inner periphery.

12. The magnetic flux path assembly of claim 8 wherein said opposed member is a plate having an outer periphery, a closed inner periphery defining an opening extending about said pole piece, said gap lying between said periphery and said pole piece, and at least one portion of said inner periphery defines said gap, and another portion of said periphery defines said portion of said airflow path defined in said opposed member.

13. The magnetic flux path assembly of claim 8 wherein:

said magnetic flux path assembly has an axis parallel to the direction of reciprocation of the voice coil, said pole piece has a distal region thereof distant from said intermediate member, said distal region having the form of a body of revolution concentric with said axis;

said opposed member is a plate having a closed inner periphery extending about said pole piece distal region;

said inner periphery has at least one sector of a circular arc concentric with said distal region, said sector having a radius, and at least one relief defined in said plate, said relief extending radially outward relative to the radius of said sector;

said gap is defined between said sector and said pole piece; and said relief defines at least a part of said portion of said airflow path defined in said opposed member.

14. The magnetic flux path assembly of claim 8 wherein:

said assembly has a central axis;

said pole piece has a round portion;

said opposed member is a disc having an outer periphery and a closed inner periphery extending about said round portion of said pole piece;

said inner periphery has a plurality of sectors of a circular arc having a common radius, and a plurality of reliefs defined in said disc extending radially outward relative to the radius of said sectors;

said round portion of said pole piece and said sectors are concentric about said axis;

said gap being defined between said sectors and said pole piece, and said portion of said airflow path being defined, at least in part, by said reliefs; and said reliefs and said sectors are arranged in a symmetrical array about said axis.

15. The magnetic flux path assembly of claim 8 wherein said pole piece includes said magnet.

16. The magnetic flux path assembly of claim 15 wherein:

said magnet has a longitudinal axis;

said magnet extends away from said intermediate member and has a distal end distant from said intermediate member;

said distal end of said magnet has a cross-section perpendicular to said axis;

said pole piece has an end cap surmounting said distal end of said magnet, said end cap having a cross-section perpendicular to the axis, said cross-section of said end cap being of greater extent than said cross-section of said distal end of said magnet; and said end cap has passages defined therethrough permitting, in use, fluid communication between the cavity and said space.

17. The magnetic flux path assembly of claim 16 wherein said end cap has an external periphery and said passages are channels formed in said periphery.

18. The magnetic flux path assembly of claim 16 wherein said end cap has a round circular periphery and said passages are apertures formed through said end cap.

19. The magnetic flux path assembly of claim 8, for a loudspeaker having a round cylindrical voice coil for driving the diaphragm along an axis of reciprocation, and supporting structure for mounting the diaphragm to the flux path assembly, wherein:

said opposed piece is a first plate mounted to one portion of said intermediate member;

said intermediate member has structure extending away from said first plate, and a second plate mounted to said structure parallel to said first plate;

said first plate has an inner periphery defining an opening, and said pole piece is mounted to extend at least partially from said second plate toward said first plate;

said pole piece and said inner periphery co-operate to define a gap for accommodating reciprocating motion of the voice coil with the pole piece located internally with respect to the voice coil;

said magnetic flux path assembly has an enclosed space defined between said pole piece, said structure, and said pair of plates;

said passageway defined in said pole piece permits fluid communication between the cavity and said space; and said portion of said airflow path defined in said opposed member includes venting defined in said first plate to permit fluid communication between said space and external ambient.

20. The magnetic flux path assembly of claim 8 wherein said portion of said airflow path defined in said opposed member includes flow director elements for enhancing convective heat transfer from the voice coil.

21. The magnetic flux path assembly of claim 8 wherein said portion of said airflow path defined in said opposed member includes at least one deflector for directing airflow toward the voice coil.

22. The magnetic flux path assembly of claim 8 wherein said portion of said airflow path defined in said opposed member includes at least one tube having an outlet oriented to urge air displaced through said tube toward a portion of the voice coil.

23. The magnetic flux path assembly of claim 22 wherein said tube is a bent tube having a pair of ends, one of said ends being oriented to urge air displaced through said tube toward a portion of the voice coil during flow in one direction, the other being oriented to urge air displaced through said tube toward a portion of the voice coil during flow in the other direction.

24. The magnetic flux path assembly of claim 8, the voice coil having an external surface, wherein:

said opposed member is a plate having a closed inner periphery defining an opening extending about said pole piece, said gap being defined between at least one portion of said periphery and said pole piece;

said venting being defined by another portion of said periphery in the nature of a relief defined in said plate, said relief extending radially away from said pole piece and permitting air to traverse said plate; and said assembly has at least one air guide mounted to said plate to direct air flowing through said relief along at least a portion of the external surface of the voice coil.

25. The magnetic flux path assembly of claim 24 wherein said assembly includes an array of said reliefs and a corresponding array of air guides spaced about the axis.

26. The magnetic flux path assembly of claim 24 wherein said assembly has an internal enclosed space, and said portion of said airflow path defined in said opposed member permits air flow between said internal enclosed space and external ambient, and said assembly has, associated with at least one said relief, an air guide mounted to extend from one side of said plate, and another air guide mounted to extend away from the other side of said plate.

27. The magnetic flux path assembly of claim 24 wherein said air guide is a channel having an open longitudinal side facing the voice coil, the voice coil is reciprocally movable parallel to an axis of reciprocation, and said channel extends parallel to the axis of reciprocation of the voice coil.

28. A magnetic flux path assembly for a loudspeaker having a diaphragm, the loudspeaker having a round cylindrical voice coil for driving the diaphragm along an axis of reciprocation, the voice coil having a diaphragm dust cap cavity defined therewithin, and supporting structure for mounting the diaphragm to the flux path assembly, wherein:

said magnetic flux path assembly has a closed back;

said magnetic flux path assembly has an annular magnet having a pair of annular faces and an inner wall defining an eye therethrough, a first plate mounted to one annular face of said magnet, a second plate mounted to the other annular face of said magnet, and a pole piece;

said first plate has an inner periphery defining an opening, and said pole piece is mounted to extend at least partially through said eye from said second plate toward said first plate;

said pole piece and said inner periphery co-operate to define a frontal gap in said magnetic flux path assembly for accommodating reciprocating motion of the voice coil, with the pole piece located internally with respect to the voice coil; said magnetic flux path assembly has a space defined between said pole piece, said inner wall of said magnet, and said pair of plates;

said pole piece has a first passageway defined therein permitting fluid communication therethrough between the cavity and said space;

said first plate has venting defined therein to permit fluid communication between said space and external ambient.

29. The magnetic flux path assembly of claim 28 wherein said venting includes at least one aperture defined in said first plate, said aperture being segregated from said opening.

30. The magnetic flux path assembly of claim 28 wherein said periphery includes:

at least one sector of a circular arc, said sector having a radius measured from said axis; and a relief defined in said first plate, said relief extending away from said axis a distance greater than the radius of said sector, whereby said venting is at least partially defined by said relief.

31. The magnetic flux path assembly of claim 28 wherein:

said pole piece is a hollow cylinder having a base end mounted to said second plate, a distal end for location within the voice coil, and a wall extending between said ends;

said base end is closed, said distal end has an opening defined therein; and said wall has at least one port defined therein to permit fluid flow between the cavity and said space through said cylinder.

32. The magnetic flux path assembly of claim 28 wherein:

said pole piece is a post having a base end mounted to said second plate, a distal end for location within the voice coil, said distal end having an end face for location facing the cavity, and a wall extending between said ends, a portion of said wall bounding said space; and said pole piece has a passageway defined therein, one end of said passageway terminating at a port defined in said end face of said distal end of said pole piece, said passageway having another end terminating at a port defined in said portion of said wall bounding said space.

33. The magnetic flux path assembly of claim 32 wherein said passageway has a first bore extending inwardly from said one end of said passageway, and a second bore extending inwardly from said other end of said passageway to intersect said first bore.

34. The magnetic flux path assembly of claim 32 wherein said second bore is a cross-bore extending fully through said pole-piece and having openings at either end thereof.

35. The magnetic flux path assembly of claim 28 wherein said passageway is a straight bore formed in said pole piece on an inclined angle relative to the axis.

36. The magnetic flux path assembly of claim 28 wherein pole piece is a post having a base end mounted to said second plate and a distal end for location within the voice coil;

said distal end has an end face for location facing the cavity;

said post has a portion between said base end and said distal end;

said portion between said base end and said distal end being narrower than said distal end;

said post has a transition wall, said transition wall extending between said distal end of said post and said portion of said post that is narrower than said distal end;

said transition wall has a portion bounding said space; and said pole piece has a passageway defined therein, one end of said passageway terminating at a port defined in said end face of said distal end of said pole piece, said passageway having another end terminating at a port defined in said portion of said transition wall bounding said space.

37. The magnetic flux path assembly of claim 28 wherein:

said pole piece is a post having a base end mounted to said second plate, a distal end for location within the voice coil, said distal end having an end face for location facing the cavity, and a wall extending between said ends, a portion of said wall bounding said space; and said distal end of said pole piece has a sidewall facing said inner periphery of said first plate, said sidewall having at least one relief defined in said sidewall, said relief extending inwardly relative to said sidewall, and said relief has a first end defined in said end face, and a second end giving onto said enclosed space, whereby air can be displaced along said relief between the cavity and the enclosed space.

38. The magnetic flux path assembly of claim 37 wherein said reliefs in said distal end of said pole piece are grooves formed in said pole piece extending parallel to the axis.

39. The magnetic flux path assembly of claim 37 wherein said inner periphery of said first plate includes:

at least one sector of a circular arc, said sector having a radius measured from said axis; and at least one first plate relief defined in said first plate, said first plate relief extending away from said axis a distance greater than the radius of said sector, whereby said venting is at least partially defined by said first plate relief.

40. The magnetic flux path assembly of claim 39 wherein said at least one first plate relief is an array of slots formed in a symmetrical pattern in said first plate relative to the axis, said at least one relief in said pole piece is an array of grooves formed in said pole piece, the number of slots is equal to the number of grooves, and said slots are aligned opposite said grooves.

41. A loudspeaker comprising:

a diaphragm assembly having a movable membrane, a dust cap mounted to said moveable membrane, a voice coil former, a voice coil formed thereon, and a cavity defined within said dust cap and said former;

a closed-back magnetic flux path assembly having a magnet, a flux land connected in a magnetically permeable path to one pole of the magnet, and a pole piece connected in a magnetically permeable path to the other pole of the magnet;

said diaphragm assembly having framing mounted to said magnetic flux path assembly, and having a suspension to permit said voice coil to reciprocate relative to said framing;

said pole piece extending within at least a part of said voice coil;

said flux land being located in spaced relationship from said pole piece to define a gap therebetween for accommodating reciprocation of the voice coil, the magnet developing a magnetic flux across the gap;

said loudspeaker having an internal space defined between said pole piece, said magnet, and said flux land;

said pole piece having a passageway defined therein having a port opening on said cavity and another port opening on said space; and said flux land having venting let therethrough to permit fluid communication between said space and an external environment;

whereby displacement of said dust cap urges fluid to be displaced between said cavity and the external environment along a fluid communication pathway that includes said passageway, said space, and said venting.

42. The loudspeaker of claim 41 wherein said pole piece is a hollow post, said port opening on said cavity being an open end of said post, said port opening on said space being an aperture let through a sidewall of said post, and said post has a base end, opposite to said open end, said base end being closed.

43. The loudspeaker of claim 41 wherein said pole piece is a post having a groove let along a face thereof, said port opening on said cavity being one end of said groove, and said port opening on said space being another part of said groove.

44. The loudspeaker of claim 43 wherein said pole piece is a post having a longitudinal axis parallel to the direction of reciprocation of said voice coil, and said groove is parallel to said axis.

45. A loudspeaker comprising:

diaphragm assembly having a movable membrane, a voice coil former, and a voice coil formed thereon;

a closed-backed magnetic flux path assembly having a-magnet, a flux land connected in a magnetically permeable path to one pole of the magnet, and a pole piece connected in a magnetically permeable path to the other pole of the magnet;

said diaphragm assembly being mounted to said magnetic flux path assembly, and having a suspension to permit said voice coil to reciprocate relative to said magnetic flux path assembly;

said pole piece extending within at least a part of the voice coil;

said flux land being located in spaced relationship from said pole piece to define a gap therebetween for accommodating reciprocation of the voice coil, the magnet developing a magnetic flux field across the gap;

a cavity being defined between said diaphragm, said voice coil former and said pole piece;

said loudspeaker having an internal space defined between said pole piece, said magnet, and said flux land;

motion of said diaphragm compelling displacement of air between said cavity and said internal space; and said flux land having venting let therethrough to permit fluid communication between said internal space and external environment; and in use, said diaphragm being movable toward said pole piece to expel air from said cavity toward said enclosed space to compel displacement of air from said enclosed space through said venting.

46. A loudspeaker comprising:

a magnetic flux path assembly and a co-operable diaphragm;

said diaphragm having a voice coil mounted thereto;

said magnetic flux path assembly having a pole piece, and an opposed piece located in opposition to said pole piece, said pole piece and said opposed piece being spaced apart to define a gap therebetween;

said voice coil being mounted for reciprocal movement in said gap;

said pole piece having a first relief formed therealong for conducting air displaced by motion of said diaphragm, said relief having an open side facing said voice coil to permit air passing through said first relief to move beside said voice coil; and said opposed piece having an inner wall facing said pole piece, said inner wall having a first portion facing said pole piece, said first portion of said inner wall facing said pole piece across said gap;

said inner wall having a second portion facing said pole piece, said second portion of said inner wall defining a second relief formed in said opposed piece for conducting air displaced in consequence of motion of said diaphragm relative to said pole piece, said second portion of said inner wall of said opposed piece extending farther away from said voice coil than said first portion of said inner wall of said opposed piece;

said second relief having an open side facing said voice coil to permit air passing through said second relief to move beside said voice coil.

47. The loud speaker of claim 46 wherein said diaphragm is operable to urge air to be displaced in a opposite directions past said voice coil in said respective reliefs of said pole piece and said opposed piece.

48. The loud speaker of claim 46 wherein said diaphragm is operable to cause air to be displaced in said reliefs adjacent to both inside and outside faces of said voice coil.

* * * * *